US010134403B2

(12) United States Patent
Kim et al.

(10) Patent No.: US 10,134,403 B2
(45) Date of Patent: Nov. 20, 2018

(54) CROSSFADING BETWEEN HIGHER ORDER AMBISONIC SIGNALS

(71) Applicant: QUALCOMM Incorporated, San Diego, CA (US)

(72) Inventors: Moo Young Kim, San Diego, CA (US); Nils Günther Peters, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 0 days.

(21) Appl. No.: 14/712,854

(22) Filed: May 14, 2015

(65) Prior Publication Data

US 2015/0332683 A1 Nov. 19, 2015

Related U.S. Application Data

(60) Provisional application No. 61/994,763, filed on May 16, 2014, provisional application No. 62/004,076, filed on May 28, 2014, provisional application No. 62/118,434, filed on Feb. 19, 2015.

(51) Int. Cl.
*G10L 19/008* (2013.01)

(52) U.S. Cl.
CPC ..... *G10L 19/008* (2013.01)

(58) Field of Classification Search
CPC ..... G10L 19/008
USPC ..... 705/500
See application file for complete search history.

(56) References Cited

U.S. PATENT DOCUMENTS

2005/0157894 A1* 7/2005 Andrews ..... H04S 7/30 381/307
2012/0053710 A1* 3/2012 Lindahl ..... G11B 20/10 700/94
2014/0016786 A1* 1/2014 Sen ..... G10L 19/008 381/23
2014/0355769 A1 12/2014 Peters et al.
2015/0213803 A1 7/2015 Peters et al.
2016/0057556 A1* 2/2016 Boehm ..... G10L 21/02 381/23

FOREIGN PATENT DOCUMENTS

WO 2014194099 A1 12/2014

OTHER PUBLICATIONS

Boehm, et al., "Scalable Decoding Mode for MPEG-H 3D Audio HOA," MPEG Meeting; Mar. 2014; Valencia; (Motion Picture Expert Group or ISO/IEC JTC1/SC29/WG11), No. m33195, XP030061647, 12 pp.

(Continued)

*Primary Examiner* — Bharatkumar S Shah
(74) *Attorney, Agent, or Firm* — Shumaker & Sieffert, P.A.

(57) ABSTRACT

In general, techniques are described for crossfading sets of spherical harmonic coefficients. An audio encoding device or audio decoding device comprising a memory and a processor may be configured to perform the techniques. The memory may be configured to store a first set of spherical harmonic coefficients (SHCs) and a second set of SHCs. The first set of SHCs describe a first sound field. The second set of SHCs describe a second sound field. The processor may be configured to crossfade between the first set of SHCs and a second set of SHCs to obtain a first set of crossfaded SHCs.

26 Claims, 14 Drawing Sheets

(56) References Cited

OTHER PUBLICATIONS

Peters, et al., "Description of Qualcomm's HoA coding technology", MPEG Meeting; Jul. 2013; Vienna; (Motion Picture Expert Group or ISO/IEC JTC1/SC29/WG11), No. m29986, XP030058515, 3 pp.
Sen, et al., "Technical Description of the Qualcomm's HoA Coding Technology for Phase II", MPEG Meeting; Jul. 2014; Sapporo; (Motion Picture Expert Group or ISO/IEC JTC1/SC29/WG11), No. m34104, XP030062477, 4 pp.
Sen, et al., "Thoughts on scalable/layered coding for the HOA signal", MPEG Meeting; Oct. 2014; Strasbourg; (Motion Picture Expert Group or ISO/IEC JTC1/SC29/WG11), No. m35160, XP030063532, 5 pp.
"WD1-HOA Text of MPEG-H 3D Audio", 107. MPEG Meeting; Jan. 2014; San Jose; (Motion Picture Expert Group or ISO/IEC JTC1/SC29/WG11), No. N14264, XP030021001, 84 pp.
"Call for Proposals for 3D Audio," ISO/IEC JTC1/SC29/WG11/N13411, Geneva, CH; Jan. 2013, 20 pp.
Herre, et al., "MPEG-H 3D Audio—The New Standard for Coding of Immersive Spatial Audio," IEEE Journal of Selected Topics in Signal Processing, vol. 9, No. 5, Aug. 2015, pp. 770-779.
Poletti, "Three-Dimensional Surround Sound Systems Based on Spherical Harmonics," J. Audio Eng. Soc., vol. 53, No. 11, Nov. 2005, pp. 1004-1025.
"Information technology—High efficiency coding and media delivery in heterogeneous environments—Part 3: Part 3: 3D Audio, Amendment 3: MPEG-H 3D Audio Phase 2," ISO/IEC JTC 1/SC 29/WG 11, Jul. 25, 2015, 208 pp.
"Information technology—High efficiency coding and media delivery in heterogeneous environments—Part 3: 3D Audio," ISO/IEC JTC 1/SC 29/ WG 11, Apr. 4, 2014, 337 pp.
"Information technology—High efficiency coding and media delivery in heterogeneous environments—Part 3: 3D Audio," ISO/IEC JTC 1/SC 29, Jul. 25, 2014, 311 pp.
International Search Report and Written Opinion from International Application No. PCT/US2015/031195, dated Oct. 26, 2015, 18 pp.
Second Written Opinion from International Application No. PCT/US2015/031195, dated May 20, 2016, 7 pp.
Response to Second Written Opinion dated May 20, 2016, from International Application No. PCT/US2015/031195, filed on Jul. 20, 2016, 5 pp.
Information technology—MPEG audio technologies—Part 3: Unified speech and audio coding, First edition, Apr. 1, 2012, 286 pp.
International Preliminary Report on Patentability from International Application No. PCT/US2015/031195, dated Sep. 8, 2016, 8 pp.

* cited by examiner $$V_x = \frac{d_2}{d_1 + d_2} V_1 + \frac{d_1}{d_1 + d_2} V_2$$

CROSSFADING BETWEEN HIGHER ORDER AMBISONIC SIGNALS

This application claims the benefit of the following U.S. Provisional applications:

U.S. Provisional Application No. 61/994,763, filed May 16, 2014, entitled "CROSSFADING BETWEEN HIGHER ORDER AMBISONIC SIGNALS;"

U.S. Provisional Application No. 62/004,076, filed May 28, 2014, entitled "CROSSFADING BETWEEN HIGHER ORDER AMBISONIC SIGNALS;" and U.S. Provisional Application No. 62/118,434, filed Feb. 19, 2015, entitled "CROSSFADING BETWEEN HIGHER ORDER AMBISONIC SIGNALS,"

where each of the foregoing listed U.S. Provisional applications is incorporated by reference as if set forth in their respective entirety herein.

TECHNICAL FIELD

This disclosure relates to audio data and, more specifically, coding of higher-order ambisonic audio data.

BACKGROUND

A higher order ambisonics (HOA) signal (often represented by a plurality of spherical harmonic coefficients (SHC) or other hierarchical elements) is a three-dimensional representation of a soundfield. This HOA or SHC representation may represent this soundfield in a manner that is independent of the local speaker geometry used to playback a multi-channel audio signal rendered from this SHC signal. This SHC signal may also facilitate backwards compatibility as this SHC signal may be rendered to well-known and highly adopted multi-channel formats, such as a 5.1 audio channel format or a 7.1 audio channel format. The SHC representation may therefore enable a better representation of a soundfield that also accommodates backward compatibility.

SUMMARY

In general, techniques are described for crossfading between ambient HOA coefficients. For example, techniques are described for crossfading between a current set of ambient HOA coefficients and a previous set of ambient HOA coefficients in the energy compensated domain. In this way, the techniques of this disclosure may smooth the transition between the previous set of ambient HOA coefficients and the current set of ambient HOA coefficients.

In one aspect, a method includes crossfading, by a device, between a first set of ambient spherical harmonic coefficients (SHCs) and a second set of ambient SHCs to obtain a first set of crossfaded ambient SHCs, wherein the first set of SHCs describe a first sound field and the second set of SHCs describe a second sound field.

In another aspect, a device includes one or more processors; and at least one module executable by the one or more processors to crossfade between a first set of ambient SHCs and a second set of ambient SHCs to obtain a first set of crossfaded ambient SHCs, wherein the first set of SHCs describe a first sound field and the second set of SHCs describe a second sound field.

In another aspect, a device includes means for obtaining a first set of ambient SHCs, wherein the first set of SHCs describe a first sound field; means for obtaining a second set of ambient SHCs, wherein the second set of SHCs describe a second sound field; and means for crossfading between the first set of ambient SHCs and the second set of ambient SHCs to obtain a first set of crossfaded ambient SHCs.

In another aspect, a computer-readable storage medium stores instructions that, when executed, cause one or more processors of a device to crossfade between a first set of ambient SHCs and a second set of ambient SHCs to obtain a first set of crossfaded ambient SHCs, wherein the first set of SHCs describe a first sound field and the second set of SHCs describe a second sound field.

In another aspect, a method comprises crossfading, by a device, between a first set of spherical harmonic coefficients (SHCs) and a second set of SHCs to obtain a first set of crossfaded SHCs, wherein the first set of SHCs describe a first sound field and the second set of SHCs describe a second sound field.

In another aspect, an audio decoding device comprises a memory configured to store a first set of spherical harmonic coefficients (SHCs) and a second set of SHCs, wherein the first set of SHCs describe a first sound field and the second set of SHCs describe a second sound field. The audio decoding device further comprises one or more processors configured to crossfade between the first set of SHCs and a second set of SHCs to obtain a first set of crossfaded ambient SHCs.

In another aspect, an audio encoding device comprises a memory configured to store a first set of spherical harmonic coefficients (SHCs) and a second set of SHCs, wherein the first set of SHCs describe a first sound field and the second set of SHCs describe a second sound field. The audio encoding device also comprises one or more processors configured to crossfade between the first set of SHCs and a second set of SHCs to obtain a first set of crossfaded SHCs.

In another aspect, an apparatus comprises means for storing a first set of spherical harmonic coefficients (SHCs) and a second set of SHCs, wherein the first set of SHCs describe a first sound field and the second set of SHCs describe a second sound field, and means for crossfading between the first set of SHCs and a second set of SHCs to obtain a first set of crossfaded SHCs.

The details of one or more aspects of the techniques are set forth in the accompanying drawings and the description below. Other features, objects, and advantages of these techniques will be apparent from the description and drawings, and from the claims.

DETAILED DESCRIPTION

Figure 1:
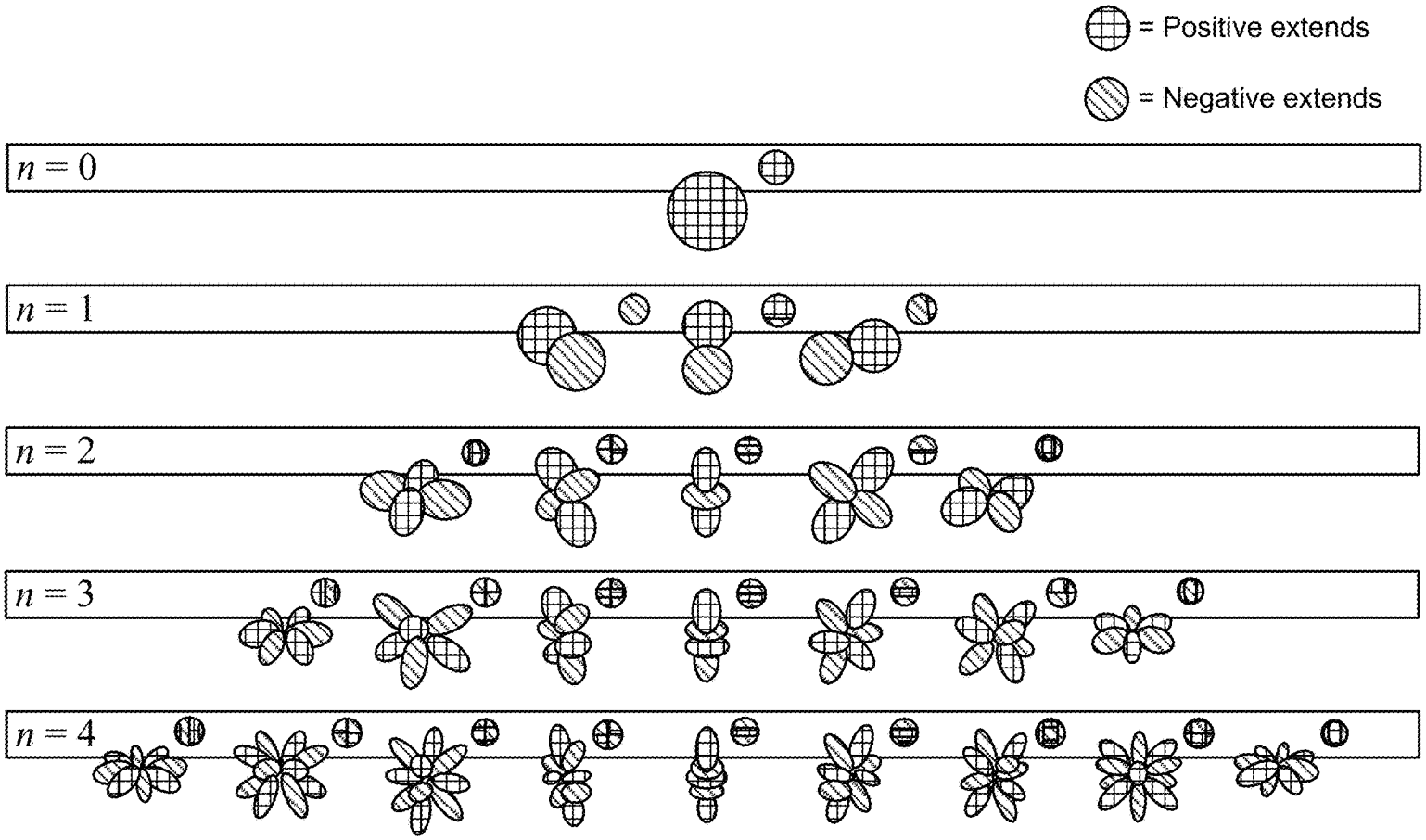
FIG. 1 is a diagram illustrating spherical harmonic basis functions of various orders and sub-orders.

The evolution of surround sound has made available many output formats for entertainment nowadays. Examples of such consumer surround sound formats are mostly 'channel' based in that they implicitly specify feeds to loudspeakers in certain geometrical coordinates. The consumer surround sound formats include the popular 5.1 format (which includes the following six channels: front left (FL), front right (FR), center or front center, back left or surround left, back right or surround right, and low frequency effects (LFE)), the growing 7.1 format, various formats that includes height speakers such as the 7.1.4 format and the 22.2 format (e.g., for use with the Ultra High Definition Television standard). Non-consumer formats can span any number of speakers (in symmetric and non-symmetric geometries) often termed 'surround arrays'. One example of such an array includes 32 loudspeakers positioned on coordinates on the corners of a truncated icosahedron.

The input to a future MPEG encoder is optionally one of three possible formats: (i) traditional channel-based audio (as discussed above), which is meant to be played through loudspeakers at pre-specified positions; (ii) object-based audio, which involves discrete pulse-code-modulation (PCM) data for single audio objects with associated metadata containing their location coordinates (amongst other information); and (iii) scene-based audio, which involves representing the soundfield using coefficients of spherical harmonic basis functions (also called "spherical harmonic coefficients" or SHC, "Higher-order Ambisonics" or HOA, and "HOA coefficients"). The future MPEG encoder may be described in more detail in a document entitled "Call for Proposals for 3D Audio," by the International Organization for Standardization/International Electrotechnical Commission (ISO)/(IEC) JTC1/SC29/WG11/N13411, released January 2013 in Geneva, Switzerland, and available at http://mpeg.chiariglione.org/sites/default/files/files/standards/parts/docs/w13411.zip.

There are various 'surround-sound' channel-based formats in the market. They range, for example, from the 5.1 home theatre system (which has been the most successful in terms of making inroads into living rooms beyond stereo) to the 22.2 system developed by NHK (Nippon Hoso Kyokai or Japan Broadcasting Corporation). Content creators (e.g., Hollywood studios) would like to produce the soundtrack for a movie once, and not spend effort to remix it for each speaker configuration. Recently, Standards Developing Organizations have been considering ways in which to provide an encoding into a standardized bitstream and a subsequent decoding that is adaptable and agnostic to the speaker geometry (and number) and acoustic conditions at the location of the playback (involving a renderer).

To provide such flexibility for content creators, a hierarchical set of elements may be used to represent a soundfield. The hierarchical set of elements may refer to a set of elements in which the elements are ordered such that a basic set of lower-ordered elements provides a full representation of the modeled soundfield. As the set is extended to include higher-order elements, the representation becomes more detailed, increasing resolution.

One example of a hierarchical set of elements is a set of spherical harmonic coefficients (SHC). The following expression demonstrates a description or representation of a soundfield using SHC:

$$p_i(t, r_r, \theta_r, \varphi_r) = \sum_{\omega=0}^{\infty}\left[4\pi\sum_{n=0}^{\infty} j_n(kr_r)\sum_{m=-n}^{n} A_n^m(k)Y_n^m(\theta_r, \varphi_r)\right]e^{j\omega t},$$

The expression shows that the pressure $p_i$ at any point $\{r_r, \theta_r, \varphi_r\}$ of the soundfield, at time t, can be represented uniquely by the SHC, $A_n^m(k)$. Here, $k=\omega/c$, c is the speed of sound (~343 m/s), $\{r_r, \theta_r, \varphi_r\}$ is a point of reference (or observation point), $j_n(\bullet)$ is the spherical Bessel function of order n, and $Y_n^m(\theta_r, \varphi_r)$ are the spherical harmonic basis functions of order n and suborder m. It can be recognized that the term in square brackets is a frequency-domain representation of the signal (i.e., $S(\omega, r_r, \theta_r, \varphi_r)$) which can be approximated by various time-frequency transformations, such as the discrete Fourier transform (DFT), the discrete cosine transform (DCT), or a wavelet transform. Other examples of hierarchical sets include sets of wavelet transform coefficients and other sets of coefficients of multiresolution basis functions.

FIG. 1 is a diagram illustrating spherical harmonic basis functions from the zero order (n=0) to the fourth order (n=4). As can be seen, for each order, there is an expansion of suborders m which are shown but not explicitly noted in the example of FIG. 1 for ease of illustration purposes.

The SHC $A_n^m(k)$ can either be physically acquired (e.g., recorded) by various microphone array configurations or, alternatively, they can be derived from channel-based or object-based descriptions of the soundfield. The SHC represent scene-based audio, where the SHC may be input to an audio encoder to obtain encoded SHC that may promote more efficient transmission or storage. For example, a fourth-order representation involving $(1+4)^2$ (25, and hence fourth order) coefficients may be used.

As noted above, the SHC may be derived from a microphone recording using a microphone array. Various examples of how SHC may be derived from microphone arrays are described in Poletti, M., "Three-Dimensional Surround Sound Systems Based on Spherical Harmonics," J. Audio Eng. Soc., Vol. 53, No. 11, 2005 November, pp. 1004-1025.

To illustrate how the SHCs may be derived from an object-based description, consider the following equation.

The coefficients $A_n^m(k)$ for the soundfield corresponding to an individual audio object may be expressed as:

$$A_n^m(k)=g(\omega)(-4\pi ik)h_n^{(2)}(kr_s)Y_n^{m*}(\theta_s,\varphi_s),$$

where i is $\sqrt{-1}$, $h_n^2(\bullet)$ is the spherical Hankel function (of the second kind) of order n, and $\{r_s, \theta_s, \varphi_s\}$ is the location of the object. Knowing the object source energy $g(\omega)$ as a function of frequency (e.g., using time-frequency analysis techniques, such as performing a fast Fourier transform on the PCM stream) allows us to convert each PCM object and the corresponding location into the SHC $A_n^m(k)$. Further, it can be shown (since the above is a linear and orthogonal decomposition) that the $A_n^m(k)$ coefficients for each object are additive. In this manner, a multitude of PCM objects can be represented by the $A_n^m(k)$ coefficients (e.g., as a sum of the coefficient vectors for the individual objects). Essentially, the coefficients contain information about the soundfield (the pressure as a function of 3D coordinates), and the above represents the transformation from individual objects to a representation of the overall soundfield, in the vicinity of the observation point $\{r_r, \theta_r, \varphi_r\}$. The remaining figures are described below in the context of object-based and SHC-based audio coding.

Figure 2:
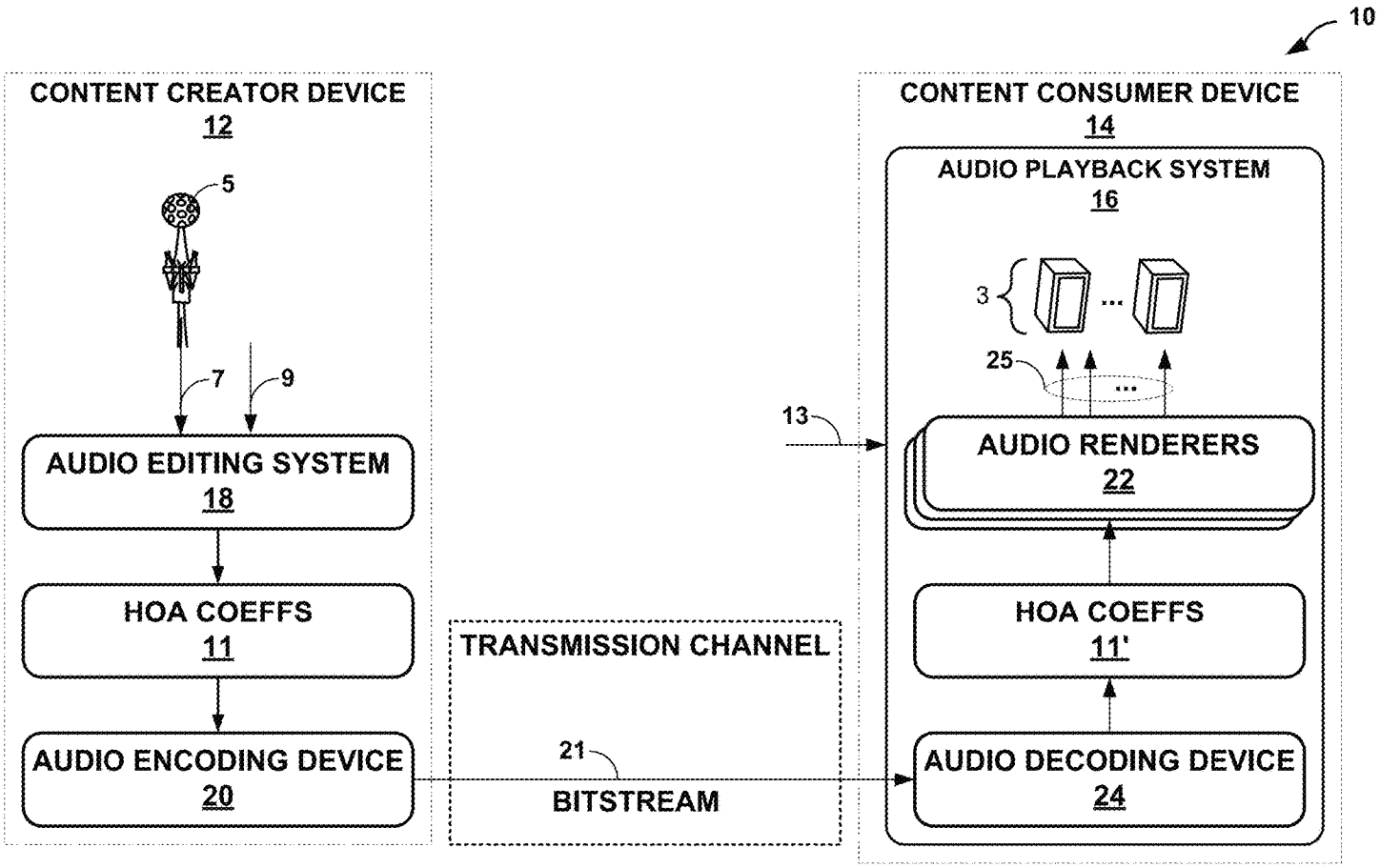
FIG. 2 is a diagram illustrating a system that may perform various aspects of the techniques described in this disclosure.

FIG. 2 is a diagram illustrating a system 10 that may perform various aspects of the techniques described in this disclosure. As shown in the example of FIG. 2, the system 10 includes a content creator device 12 and a content consumer device 14. While described in the context of the content creator device 12 and the content consumer device 14, the techniques may be implemented in any context in which SHCs (which may also be referred to as HOA coefficients) or any other hierarchical representation of a soundfield are encoded to form a bitstream representative of the audio data. Moreover, the content creator device 12 may represent any form of computing device capable of implementing the techniques described in this disclosure, including a handset (or cellular phone), a tablet computer, a smart phone, or a desktop computer to provide a few examples. Likewise, the content consumer device 14 may represent any form of computing device capable of implementing the techniques described in this disclosure, including a handset (or cellular phone), a tablet computer, a smart phone, a set-top box, or a desktop computer to provide a few examples.

The content creator device 12 may be operated by a movie studio or other entity that may generate multi-channel audio content for consumption by operators of content consumer devices, such as the content consumer device 14. In some examples, the content creator device 12 may be operated by an individual user who would like to compress HOA coefficients 11. Often, the content creator generates audio content in conjunction with video content. The content consumer device 14 may be operated by an individual. The content consumer device 14 may include an audio playback system 16, which may refer to any form of audio playback system capable of rendering SHC for play back as multi-channel audio content.

The content creator device 12 includes an audio editing system 18. The content creator device 12 obtain live recordings 7 in various formats (including directly as HOA coefficients) and audio objects 9, which the content creator device 12 may edit using audio editing system 18. A microphone 5 may capture the live recordings 7. The content creator may, during the editing process, render HOA coefficients 11 from audio objects 9, listening to the rendered speaker feeds in an attempt to identify various aspects of the soundfield that require further editing. The content creator device 12 may then edit HOA coefficients 11 (potentially indirectly through manipulation of different ones of the audio objects 9 from which the source HOA coefficients may be derived in the manner described above). The content creator device 12 may employ the audio editing system 18 to generate the HOA coefficients 11. The audio editing system 18 represents any system capable of editing audio data and outputting the audio data as one or more source spherical harmonic coefficients.

When the editing process is complete, the content creator device 12 may generate a bitstream 21 based on the HOA coefficients 11. That is, the content creator device 12 includes an audio encoding device 20 that represents a device configured to encode or otherwise compress HOA coefficients 11 in accordance with various aspects of the techniques described in this disclosure to generate the bitstream 21. The audio encoding device 20 may generate the bitstream 21 for transmission, as one example, across a transmission channel, which may be a wired or wireless channel, a data storage device, or the like. The bitstream 21 may represent an encoded version of the HOA coefficients 11 and may include a primary bitstream and another side bitstream, which may be referred to as side channel information.

While shown in FIG. 2 as being directly transmitted to the content consumer device 14, the content creator device 12 may output the bitstream 21 to an intermediate device positioned between the content creator device 12 and the content consumer device 14. The intermediate device may store the bitstream 21 for later delivery to the content consumer device 14, which may request the bitstream. The intermediate device may comprise a file server, a web server, a desktop computer, a laptop computer, a tablet computer, a mobile phone, a smart phone, or any other device capable of storing the bitstream 21 for later retrieval by an audio decoder. The intermediate device may reside in a content delivery network capable of streaming the bitstream 21 (and possibly in conjunction with transmitting a corresponding video data bitstream) to subscribers, such as the content consumer device 14, requesting the bitstream 21.

Alternatively, the content creator device 12 may store the bitstream 21 to a storage medium, such as a compact disc, a digital video disc, a high definition video disc or other storage media, most of which are capable of being read by a computer and therefore may be referred to as computer-readable storage media or non-transitory computer-readable storage media. In this context, the transmission channel may refer to the channels by which content stored to the mediums are transmitted (and may include retail stores and other store-based delivery mechanism). In any event, the techniques of this disclosure should not therefore be limited in this respect to the example of FIG. 2.

As further shown in the example of FIG. 2, the content consumer device 14 includes the audio playback system 16. The audio playback system 16 may represent any audio playback system capable of playing back multi-channel audio data. The audio playback system 16 may include a number of different renderers 22. The renderers 22 may each provide for a different form of rendering, where the different forms of rendering may include one or more of the various ways of performing vector-base amplitude panning (VBAP), and/or one or more of the various ways of performing soundfield synthesis. As used herein, "A and/or B" means "A or B", or both "A and B".

The audio playback system 16 may further include an audio decoding device 24. The audio decoding device 24 may represent a device configured to decode HOA coefficients 11' from the bitstream 21, where the HOA coefficients 11' may be similar to the HOA coefficients 11 but differ due to lossy operations (e.g., quantization) and/or transmission via the transmission channel. The audio playback system 16 may, after decoding the bitstream 21 to obtain the HOA coefficients 11' and render the HOA coefficients 11' to output loudspeaker feeds 25. The loudspeaker feeds 25 may drive one or more loudspeakers (which are not shown in the example of FIG. 2 for ease of illustration purposes).

To select the appropriate renderer or, in some instances, generate an appropriate renderer, the audio playback system 16 may obtain loudspeaker information 13 indicative of a number of loudspeakers and/or a spatial geometry of the loudspeakers. In some instances, the audio playback system 16 may obtain the loudspeaker information 13 using a reference microphone and driving the loudspeakers in such a manner as to dynamically determine the loudspeaker information 13. In other instances or in conjunction with the dynamic determination of the loudspeaker information 13, the audio playback system 16 may prompt a user to interface with the audio playback system 16 and input the loudspeaker information 13.

The audio playback system 16 may then select one of the audio renderers 22 based on the loudspeaker information 13. In some instances, the audio playback system 16 may, when none of the audio renderers 22 are within some threshold similarity measure (in terms of the loudspeaker geometry) to the loudspeaker geometry specified in the loudspeaker information 13, generate the one of audio renderers 22 based on the loudspeaker information 13. The audio playback system 16 may, in some instances, generate one of the audio renderers 22 based on the loudspeaker information 13 without first attempting to select an existing one of the audio renderers 22. One or more speakers 3 may then playback the rendered loudspeaker feeds 25.

Figure 3:
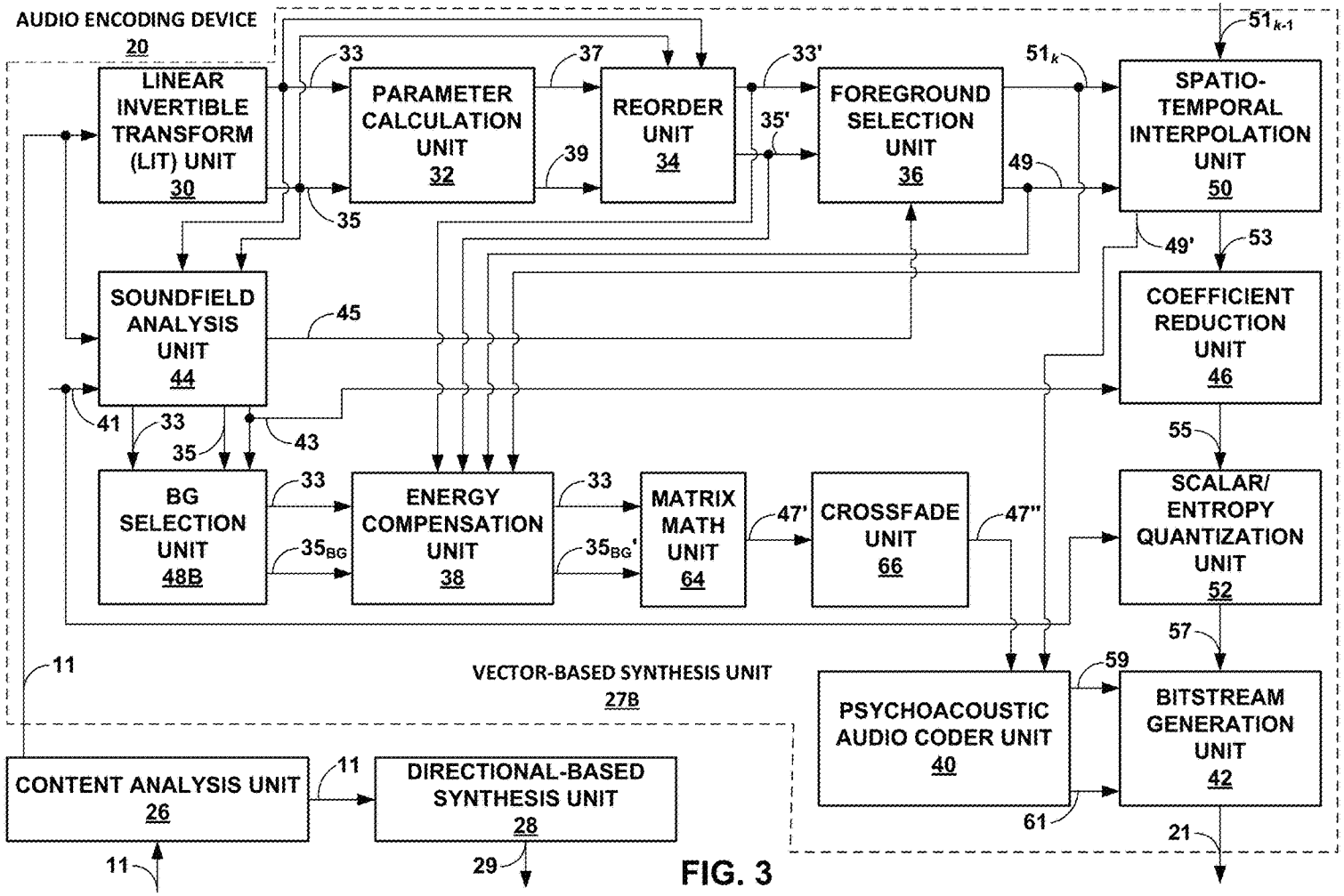
FIG. 3 is a block diagram illustrating, in more detail, one example of the audio encoding device shown in the example of FIG. 2 that may perform various aspects of the techniques described in this disclosure.

FIG. 3 is a block diagram illustrating, in more detail, one example of the audio encoding device 20 shown in the example of FIG. 2 that may perform various aspects of the techniques described in this disclosure. The audio encoding device 20 includes a content analysis unit 26, a vector-based decomposition unit 27 and a directional-based decomposition unit 28. Although described briefly below, more information regarding the audio encoding device 20 and the various aspects of compressing or otherwise encoding HOA coefficients is available in International Patent Application Publication No. WO 2014/194099, entitled "INTERPOLATION FOR DECOMPOSED REPRESENTATIONS OF A SOUND FIELD," filed 29 May 2014.

The content analysis unit 26 represents a unit configured to analyze the content of the HOA coefficients 11 to identify whether the HOA coefficients 11 represent content generated from a live recording or an audio object. The content analysis unit 26 may determine whether the HOA coefficients 11 were generated from a recording of an actual soundfield or from an artificial audio object. In some instances, when the framed HOA coefficients 11 were generated from a recording, the content analysis unit 26 passes the HOA coefficients 11 to the vector-based decomposition unit 27. In some instances, when the framed HOA coefficients 11 were generated from a synthetic audio object, the content analysis unit 26 passes the HOA coefficients 11 to the directional-based synthesis unit 28. The directional-based synthesis unit 28 may represent a unit configured to perform a directional-based synthesis of the HOA coefficients 11 to generate a directional-based bitstream 21.

As shown in the example of FIG. 3, the vector-based decomposition unit 27 may include a linear invertible transform (LIT) unit 30, a parameter calculation unit 32, a reorder unit 34, a foreground selection unit 36, an energy compensation unit 38, a psychoacoustic audio coder unit 40, a bitstream generation unit 42, a soundfield analysis unit 44, a coefficient reduction unit 46, a background (BG) selection unit 48, a spatio-temporal interpolation unit 50, and a quantization unit 52.

The linear invertible transform (LIT) unit 30 receives the HOA coefficients 11 in the form of HOA channels, each channel representative of a block or frame of a coefficient associated with a given order, sub-order of the spherical basis functions (which may be denoted as HOA[k], where k may denote the current frame or block of samples). The matrix of HOA coefficients 11 may have dimensions D: $M\times(N+1)^2$.

The LIT unit 30 may represent a unit configured to perform a form of analysis referred to as singular value decomposition. While described with respect to SVD, the techniques described in this disclosure may be performed with respect to any similar transformation or decomposition that provides for sets of linearly uncorrelated, energy compacted output. Also, reference to "sets" in this disclosure is generally intended to refer to non-zero sets unless specifically stated to the contrary and is not intended to refer to the classical mathematical definition of sets that includes the so-called "empty set." An alternative transformation may comprise a principal component analysis, which is often referred to as "PCA." Depending on the context, PCA may be referred to by a number of different names, such as discrete Karhunen-Loeve transform, the Hotelling transform, proper orthogonal decomposition (POD), and eigenvalue decomposition (EVD) to name a few examples. Properties of such operations that are conducive to the underlying goal of compressing audio data are 'energy compaction' and 'decorrelation' of the multichannel audio data.

In any event, assuming the LIT unit 30 performs a singular value decomposition (which, again, may be referred to as "SVD") for purposes of example, the LIT unit 30 may transform the HOA coefficients 11 into two or more sets of transformed HOA coefficients. The "sets" of transformed HOA coefficients may include vectors of transformed HOA coefficients. In the example of FIG. 3, the LIT unit 30 may perform the SVD with respect to the HOA coefficients 11 to generate a so-called V matrix, an S matrix, and a U matrix. SVD, in linear algebra, may represent a factorization of a y-by-z real or complex matrix X (where X may represent multi-channel audio data, such as the HOA coefficients 11) in the following form:

$$X=USV^*$$

U may represent a y-by-y real or complex unitary matrix, where the y columns of U are known as the left-singular vectors of the multi-channel audio data. S may represent a y-by-z rectangular diagonal matrix with non-negative real numbers on the diagonal, where the diagonal values of S are known as the singular values of the multi-channel audio data. V* (which may denote a conjugate transpose of V) may represent a z-by-z real or complex unitary matrix, where the z columns of V* are known as the right-singular vectors of the multi-channel audio data.

In some examples, the V* matrix in the SVD mathematical expression referenced above is denoted as the conjugate transpose of the V matrix to reflect that SVD may be applied to matrices comprising complex numbers. When applied to matrices comprising only real-numbers, the complex conjugate of the V matrix (or, in other words, the V* matrix) may be considered to be the transpose of the V matrix.

Below it is assumed, for ease of illustration purposes, that the HOA coefficients 11 comprise real-numbers with the result that the V matrix is output through SVD rather than the V* matrix. Moreover, while denoted as the V matrix in this disclosure, reference to the V matrix should be understood to refer to the transpose of the V matrix where appropriate. While assumed to be the V matrix, the techniques may be applied in a similar fashion to HOA coefficients 11 having complex coefficients, where the output of the SVD is the V* matrix. Accordingly, the techniques should not be limited in this respect to only provide for application of SVD to generate a V matrix, but may include application of SVD to HOA coefficients 11 having complex components to generate a V* matrix.

In this way, the LIT unit 30 may perform SVD with respect to the HOA coefficients 11 to output US[k] vectors 33 (which may represent a combined version of the S vectors and the U vectors) having dimensions D: $M\times(N+1)^2$, and V[k] vectors 35 having dimensions D: $(N+1)^2\times(N+1)^2$. Individual vector elements in the US[k] matrix may also be termed $X_{PS}(k)$ while individual vectors of the V[k] matrix may also be termed v(k).

An analysis of the U, S and V matrices may reveal that the matrices carry or represent spatial and temporal characteristics of the underlying soundfield represented above by X. Each of the N vectors in U (of length M samples) may represent normalized separated audio signals as a function of time (for the time period represented by M samples), that are orthogonal to each other and that have been decoupled from any spatial characteristics (which may also be referred to as directional information). The spatial characteristics, representing spatial shape and position (r, theta, phi) may instead be represented by individual $i^{th}$ vectors, $v^{(i)}(k)$, in the V matrix (each of length $(N+1)^2$). The individual elements of each of $v^{(i)}(k)$ vectors may represent an HOA coefficient describing the shape (including width) and position of the soundfield for an associated audio object. Both the vectors in the U matrix and the V matrix are normalized such that their root-mean-square energies are equal to unity. The energy of the audio signals in U are thus represented by the diagonal elements in S. Multiplying U and S to form US[k] (with individual vector elements $X_{PS}(k)$), thus represent the audio signal with energies. The ability of the SVD decomposition to decouple the audio time-signals (in U), their energies (in S) and their spatial characteristics (in V) may support various aspects of the techniques described in this disclosure. Further, the model of synthesizing the underlying HOA[k] coefficients, X, by a vector multiplication of US[k] and V[k] gives rise the term "vector-based decomposition," which is used throughout this document.

Although described as being performed directly with respect to the HOA coefficients 11, the LIT unit 30 may apply the linear invertible transform to derivatives of the HOA coefficients 11. For example, the LIT unit 30 may apply SVD with respect to a power spectral density matrix derived from the HOA coefficients 11. By performing SVD with respect to the power spectral density (PSD) of the HOA coefficients rather than the coefficients themselves, the LIT unit 30 may potentially reduce the computational complexity of performing the SVD in terms of one or more of processor cycles and storage space, while achieving the same source audio encoding efficiency as if the SVD were applied directly to the HOA coefficients.

The parameter calculation unit 32 represents a unit configured to calculate various parameters, such as a correlation parameter (R), directional properties parameters (θ, ω, r), and an energy property (e). Each of the parameters for the current frame may be denoted as R[k], θ[k], φ[k], r[k] and e[k]. The parameter calculation unit 32 may perform an energy analysis and/or correlation (or so-called cross-correlation) with respect to the US[k] vectors 33 to identify the parameters. The parameter calculation unit 32 may also determine the parameters for the previous frame, where the previous frame parameters may be denoted R[k−1], θ[k−1], φ[k−1], r[k−1] and e[k−1], based on the previous frame of US[k−1] vector and V[k−1] vectors. The parameter calculation unit 32 may output the current parameters 37 and the previous parameters 39 to reorder unit 34.

The parameters calculated by the parameter calculation unit 32 may be used by the reorder unit 34 to re-order the audio objects to represent their natural evaluation or continuity over time. The reorder unit 34 may compare each of the parameters 37 from the first US[k] vectors 33 turn-wise against each of the parameters 39 for the second US[k−1] vectors 33. The reorder unit 34 may reorder (using, as one example, a Hungarian algorithm) the various vectors within the US[k] matrix 33 and the V[k] matrix 35 based on the current parameters 37 and the previous parameters 39 to output a reordered US[k] matrix 33' (which may be denoted mathematically as $\overline{US}[k]$) and a reordered V[k] matrix 35' (which may be denoted mathematically as $\overline{V}[k]$) to a foreground sound (or predominant sound—PS) selection unit 36 ("foreground selection unit 36") and an energy compensation unit 38.

The soundfield analysis unit 44 may represent a unit configured to perform a soundfield analysis with respect to the HOA coefficients 11 so as to potentially achieve a target bitrate 41. The soundfield analysis unit 44 may, based on the analysis and/or on a received target bitrate 41, determine the total number of psychoacoustic coder instantiations (which may be a function of the total number of ambient or background channels ($BG_{TOT}$) and the number of foreground channels or, in other words, predominant channels. The total number of psychoacoustic coder instantiations can be denoted as numHOATransportChannels.

The soundfield analysis unit 44 may also determine, again to potentially achieve the target bitrate 41, the total number of foreground channels (nFG) 45, the minimum order of the background (or, in other words, ambient) soundfield ($N_{BG}$ or, alternatively, MinAmbHOAorder), the corresponding number of actual channels representative of the minimum order of background soundfield (nBGa=(MinAmbHOAorder+1)$^2$), and indices (i) of additional BG HOA channels to send (which may collectively be denoted as background channel information 43 in the example of FIG. 3). The background channel information 42 may also be referred to as ambient channel information 43. Each of the channels that remains from numHOATransportChannels-nBGa, may either be an "additional background/ambient channel", an "active vector-based predominant channel", an "active directional based predominant signal" or "completely inactive". In one aspect, the channel types may be indicated (as a "ChannelType") syntax element by two bits (e.g. 00: directional based signal; 01: vector-based predominant signal; 10: additional ambient signal; 11: inactive signal). The total number of background or ambient signals, nBGa, may be given by (MinAmbHOAorder+1)$^2$+the number of times the index 10 (in the above example) appears as a channel type in the bitstream for that frame.

The soundfield analysis unit 44 may select the number of background (or, in other words, ambient) channels and the number of foreground (or, in other words, predominant) channels based on the target bitrate 41, selecting more background and/or foreground channels when the target bitrate 41 is relatively higher (e.g., when the target bitrate 41 equals or is greater than 512 Kbps). In one aspect, the numHOATransportChannels may be set to 8 while the MinAmbHOAorder may be set to 1 in the header section of the bitstream. In this scenario, at every frame, four channels may be dedicated to represent the background or ambient portion of the soundfield while the other 4 channels can, on a frame-by-frame basis vary on the type of channel—e.g., either used as an additional background/ambient channel or a foreground/predominant channel. The foreground/predominant signals can be one of either vector-based or directional based signals, as described above.

In some instances, the total number of vector-based predominant signals for a frame, may be given by the number of times the ChannelType index is 01 in the bitstream of that frame. In the above aspect, for every additional background/ambient channel (e.g., corresponding to a ChannelType of 10), corresponding information of which of the possible HOA coefficients (beyond the first four) may be represented in that channel. The information, for fourth order HOA content, may be an index to indicate the HOA coefficients 5-25. The first four ambient HOA coefficients 1-4 may be sent all the time when minAmbHOAorder is set to 1, hence the audio encoding device may only need to indicate one of the additional ambient HOA coefficient having an index of 5-25. The information could thus be sent using a 5 bits syntax element (for $4^{th}$ order content), which may be denoted as "CodedAmbCoeffIdx." In any event, the soundfield analysis unit 44 outputs the background channel information 43, the US[k] vectors 33, and the V[k] vectors 35 to one or more other components of vector-based synthesis unit 27B, such as the BG selection unit 48B.

BG selection unit 48 may represent a unit configured to determine background or ambient $V_{BG}$[k] vectors $\mathbf{35}_{BG}$ based on the background channel information (e.g., the background soundfield ($N_{BG}$) and the number (nBGa) and the indices (i) of additional BG HOA channels to send). For example, when $N_{BG}$ equals one, the background selection unit 48 may select the V[k] vectors 35 for each sample of the audio frame having an order equal to or less than one as the $V_{BG}$[k] vectors $\mathbf{35}_{BG}$. The background selection unit 48 may, in this example, then select the V[k] vectors 35 having an index identified by one of the indices (i) as additional $V_{BG}$[k] vectors $\mathbf{35}_{BG}$, where the nBGa is provided to the bitstream generation unit 42 to be specified in the bitstream 21 so as to enable the audio decoding device, such as the audio decoding device 24 shown in the example of FIG. 4, to parse the BG HOA coefficients 47 from the bitstream 21. The background selection unit 48 may then output the $V_{BG}$[k] vectors $\mathbf{35}_{BG}$ to one or more other components of crossfade unit 66, such as energy compensation unit 38. The $V_{BG}$ [k] vectors $\mathbf{35}_{BG}$ may have dimensions D: $[(N_{BG}+1)^2+nBGa]\times(N+1)^2$. In some examples, BG selection unit 48 may also output the US[k] vectors 33 to one or more other components of crossfade unit 66, such as energy compensation unit 38.

Energy compensation unit 38 may represent a unit configured to perform energy compensation with respect to the $V_{BG}$[k] vectors $\mathbf{35}_{BG}$ to compensate for energy loss due to removal of various ones of the V[k] vectors 35 by the background selection unit 48. The energy compensation unit 38 may perform an energy analysis with respect to one or more of the reordered US[k] matrix 33', the reordered V[k] matrix 35', the nFG signals 49, the foreground V[k] vectors $\mathbf{51}_k$ and the $V_{BG}$[k] vectors $\mathbf{35}_{BG}$ and then perform energy compensation based on this energy analysis to generate energy compensated $V_{BG}$[k] vectors $\mathbf{35}_{BG}$'. The energy compensation unit 38 may output the energy compensated $V_{BG}$[k] vectors $\mathbf{35}_{BG}$' to one or more other components of vector-based synthesis unit 27, such as matrix math unit 64. In some examples, energy compensation unit 38 may also output the US[k] vectors 33 to one or more other components of crossfade unit 66, such as matrix math unit 64.

Matrix math unit 64 may represent a unit configured to perform any variety of operations on one or more matrices. In the example of FIG. 3, matrix math unit 64 may be configured to multiply the US[k] vectors 33 by energy compensated $V_{BG}$[k] vectors $\mathbf{35}_{BG}$' to obtain energy compensated ambient HOA coefficients 47'. Matrix math unit 64 may provide the determined energy compensated ambient HOA coefficients 47' to one or more other components of vector-based synthesis unit 27, such as crossfade unit 66. The energy compensated ambient HOA coefficients 47' may have dimensions D: $M\times[(N_{BG}+1)^2+nBGa]$.

Crossfade unit 66 may represent a unit configured to perform crossfading between signals. For instance, crossfade unit 66 may crossfade between the energy compensated ambient HOA coefficients 47' of frame k and the energy compensated ambient HOA coefficients 47' of a previous frame k−1 to determine crossfaded energy compensated ambient HOA coefficients 47" for frame k. Crossfade unit 66 may output the determine crossfaded energy compensated ambient HOA coefficients 47" for frame k to one or more other components of vector-based synthesis unit 27, such as psychoacoustic audio coder unit 40.

In some examples, crossfade unit 66 may crossfade between the energy compensated ambient HOA coefficients 47' of frame k and the energy compensated ambient HOA coefficients 47' of a previous frame k−1 by modifying a portion of the energy compensated ambient HOA coefficients 47' of frame k based on a portion of the energy compensated ambient HOA coefficients 47' of frame k−1. In some examples, crossfade unit 66 may remove a portion of the coefficients when determining crossfaded energy compensated ambient HOA coefficients 47". Additional details of crossfade unit 66 are provided below with reference to FIG. 14.

The foreground selection unit 36 may represent a unit configured to select the reordered US[k] matrix 33' and the reordered V[k] matrix 35' that represent foreground or distinct components of the soundfield based on nFG 45 (which may represent a one or more indices identifying the foreground vectors). The foreground selection unit 36 may output nFG signals 49 (which may be denoted as a reordered $US[k]_{1,\ldots,nFG}$ 49, $FG_{1,\ldots,nfG}$[k] 49, or $X_{PS}^{(1\ldots nFG)}$(k) 49) to the psychoacoustic audio coder unit 40, where the nFG signals 49 may have dimensions D: M×nFG and each represent mono-audio objects. The foreground selection unit 36 may also output the reordered V[k] matrix 35' (or $v^{(1\ldots nFG)}$(k) 35') corresponding to foreground components of the soundfield to the spatio-temporal interpolation unit 50, where a subset of the reordered V[k] matrix 35' corresponding to the foreground components may be denoted as foreground V[k] matrix $\mathbf{51}_k$ (which may be mathematically denoted as, $\overline{V}_{1,\ldots,nFG}$[k]) having dimensions D: $(N+1)^2\times$ nFG.

The spatio-temporal interpolation unit 50 may represent a unit configured to receive the foreground V[k] vectors $\mathbf{51}_k$ for the k'th frame and the foreground V[k−1] vectors $\mathbf{51}_{k-1}$ for the previous frame (hence the k−1 notation) and perform spatio-temporal interpolation to generate interpolated foreground V[k] vectors. The spatio-temporal interpolation unit 50 may recombine the nFG signals 49 with the foreground V[k] vectors $\mathbf{51}_k$ to recover reordered foreground HOA coefficients. The spatio-temporal interpolation unit 50 may then divide the reordered foreground HOA coefficients by the interpolated V[k] vectors to generate interpolated nFG signals 49'. The spatio-temporal interpolation unit 50 may also output those of the foreground V[k] vectors $\mathbf{51}_k$ that were used to generate the interpolated foreground V[k] vectors so that an audio decoding device, such as the audio decoding device 24, may generate the interpolated foreground V[k] vectors and thereby recover the foreground V[k] vectors $\mathbf{51}_k$. Those of the foreground V[k] vectors $\mathbf{51}_k$ used to generate the interpolated foreground V[k] vectors are denoted as the remaining foreground V[k] vectors 53. In order to ensure that the same V[k] and V[k−1] are used at the encoder and decoder (to create the interpolated vectors V[k]) quantized/dequantized versions of these may be used at the encoder and decoder.

In this respect, the spatio-temporal interpolation unit 50 may represent a unit that interpolates a first portion of a first audio frame from some other portions of the first audio frame and a second temporally subsequent or preceding audio frame. In some examples, the portions may be denoted as sub-frames, where interpolation as performed with respect to sub-frames is described in more detail below with respect to FIGS. 45-46E. In other examples, the spatio-temporal interpolation unit 50 may operate with respect to some last number of samples of the previous frame and some first number of samples of the subsequent frame, as described in more detail with respect to FIGS. 37-39. The spatio-temporal interpolation unit 50 may, in performing this interpolation, reduce the number of samples of the foreground V[k] vectors $\mathbf{51}_k$ that are required to be specified in the bitstream 21, as only those of the foreground V[k] vectors $\mathbf{51}_k$ that are used to generate the interpolated V[k] vectors represent a subset of the foreground V[k] vectors $\mathbf{51}_k$. That is, in order to potentially make compression of the HOA coefficients 11 more efficient (by reducing the number of the foreground V[k] vectors $\mathbf{51}_k$ that are specified in the bitstream 21), various aspects of the techniques described in this disclosure may provide for interpolation of one or more portions of the first audio frame, where each of the portions may represent decomposed versions of the HOA coefficients 11.

The spatio-temporal interpolation may result in a number of benefits. First, the nFG signals 49 may not be continuous from frame to frame due to the block-wise nature in which the SVD or other LIT is performed. In other words, given that the LIT unit 30 applies the SVD on a frame-by-frame basis, certain discontinuities may exist in the resulting transformed HOA coefficients as evidence for example by the unordered nature of the US[k] matrix 33 and V[k] matrix 35. By performing this interpolation, the discontinuity may be reduced given that interpolation may have a smoothing effect that potentially reduces any artifacts introduced due to frame boundaries (or, in other words, segmentation of the HOA coefficients 11 into frames). Using the foreground V[k] vectors $\mathbf{51}_k$ to perform this interpolation and then generating the interpolated nFG signals 49' based on the interpolated foreground V[k] vectors $\mathbf{51}_k$ from the recovered reordered HOA coefficients may smooth at least some effects due to the frame-by-frame operation as well as due to reordering the nFG signals 49.

In operation, the spatio-temporal interpolation unit 50 may interpolate one or more sub-frames of a first audio frame from a first decomposition, e.g., foreground V[k] vectors $\mathbf{51}_k$, of a portion of a first plurality of the HOA coefficients 11 included in the first frame and a second decomposition, e.g., foreground V[k] vectors $\mathbf{51}_{k-1}$, of a portion of a second plurality of the HOA coefficients 11 included in a second frame to generate decomposed interpolated spherical harmonic coefficients for the one or more sub-frames.

In some examples, the first decomposition comprises the first foreground V[k] vectors $\mathbf{51}_k$ representative of right-singular vectors of the portion of the HOA coefficients 11. Likewise, in some examples, the second decomposition comprises the second foreground V[k] vectors $\mathbf{51}_k$ representative of right-singular vectors of the portion of the HOA coefficients 11.

In other words, spherical harmonics-based 3D audio may be a parametric representation of the 3D pressure field in terms of orthogonal basis functions on a sphere. The higher the order N of the representation, the potentially higher the spatial resolution, and often the larger the number of spherical harmonics (SH) coefficients (for a total of $(N+1)^2$ coefficients). For many applications, a bandwidth compression of the coefficients may be required for being able to transmit and store the coefficients efficiently. This techniques directed in this disclosure may provide a frame-based, dimensionality reduction process using Singular Value Decomposition (SVD). The SVD analysis may decompose each frame of coefficients into three matrices U, S and V. In some examples, the techniques may handle some of the vectors in US[k] matrix as foreground components of the underlying soundfield. However, when handled in this manner, these vectors (in U S[k] matrix) are discontinuous from frame to frame—even though they represent the same distinct audio component. These discontinuities may lead to significant artifacts when the components are fed through transform-audio-coders.

The techniques described in this disclosure may address this discontinuity. That is, the techniques may be based on the observation that the V matrix can be interpreted as orthogonal spatial axes in the Spherical Harmonics domain. The U[k] matrix may represent a projection of the Spherical Harmonics (HOA) data in terms of those basis functions, where the discontinuity can be attributed to orthogonal spatial axis (V[k]) that change every frame—and are therefore discontinuous themselves. This is unlike similar decomposition, such as the Fourier Transform, where the basis functions are, in some examples, constant from frame to frame. In these terms, the SVD may be considered of as a matching pursuit algorithm. The techniques described in this disclosure may enable the spatio-temporal interpolation unit 50 to maintain the continuity between the basis functions (V[k]) from frame to frame—by interpolating between them.

As noted above, the interpolation may be performed with respect to samples. This case is generalized in the above description when the subframes comprise a single set of samples. In both the case of interpolation over samples and over subframes, the interpolation operation may take the form of the following equation:

$$\overline{v(l)}=w(l)v(k)+(1-w(l))v(k-1).$$

In this above equation, the interpolation may be performed with respect to the single V-vector v(k) from the single V-vector v(k−1), which in one embodiment could represent V-vectors from adjacent frames k and k−1. In the above equation, l, represents the resolution over which the interpolation is being carried out, where l may indicate a integer sample and l=1, . . . , T (where T is the length of samples over which the interpolation is being carried out and over which the output interpolated vectors, $\overline{v(l)}$ are required and also indicates that the output of this process produces l of these vectors). Alternatively, l could indicate subframes consisting of multiple samples. When, for example, a frame is divided into four subframes, l may comprise values of 1, 2, 3 and 4, for each one of the subframes. The value of l may be signaled as a field termed "CodedSpatialInterpolationTime" through a bitstream—so that the interpolation operation may be replicated in the decoder. The w(l) may comprise values of the interpolation weights. When the interpolation is linear, w(l) may vary linearly and monotonically between 0 and 1, as a function of l. In other instances, w(l) may vary between 0 and 1 in a non-linear but monotonic fashion (such as a quarter cycle of a raised cosine) as a function of l. The function, w(l), may be indexed between a few different possibilities of functions and signaled in the bitstream as a field termed "SpatialInterpolationMethod" such that the identical interpolation operation may be replicated by the decoder. When w(l) is a value close to 0, the output, $\overline{v(l)}$ may be highly weighted or influenced by v(k−1). Whereas when w(l) is a value close to 1, it ensures that the output, $\overline{v(l)}$, is highly weighted or influenced by v(k−1).

The coefficient reduction unit 46 may represent a unit configured to perform coefficient reduction with respect to the remaining foreground V[k] vectors 53 based on the background channel information 43 to output reduced foreground V[k] vectors 55 to the quantization unit 52. The reduced foreground V[k] vectors 55 may have dimensions D: $[(N+1)^2-(N_{BG}+1)^2-BG_{TOT}]\times nFG$. The coefficient reduction unit 46 may, in this respect, represent a unit configured to reduce the number of coefficients in the remaining foreground V[k] vectors 53. In other words, coefficient reduction unit 46 may represent a unit configured to eliminate the coefficients in the foreground V[k] vectors (that form the remaining foreground V[k] vectors 53) having little to no directional information. In some examples, the coefficients of the distinct or, in other words, foreground V[k] vectors corresponding to a first and zero order basis functions (which may be denoted as $N_{BG}$) provide little directional information and therefore can be removed from the foreground V-vectors (through a process that may be referred to as "coefficient reduction"). In this example, greater flexibility may be provided to not only identify the coefficients that correspond $N_{BG}$ but to identify additional HOA channels (which may be denoted by the variable TotalOfAddAmbHOAChan) from the set of $[(N_{BG}+1)^2+1, (N+1)^2]$.

The quantization unit 52 may represent a unit configured to perform any form of quantization to compress the reduced foreground V[k] vectors 55 to generate coded foreground V[k] vectors 57, outputting the coded foreground V[k] vectors 57 to the bitstream generation unit 42. In operation, the quantization unit 52 may represent a unit configured to compress a spatial component of the soundfield, i.e., one or more of the reduced foreground V[k] vectors 55 in this example. The quantization unit 52 may perform any one of the following 12 quantization modes, as indicated by a quantization mode syntax element denoted "NbitsQ":

| NbitsQ value | Type of Quantization Mode |
|---|---|
| 0-3: | Reserved |
| 4: | Vector Quantization |
| 5: | Scalar Quantization without Huffman Coding |
| 6: | 6-bit Scalar Quantization with Huffman Coding |
| 7: | 7-bit Scalar Quantization with Huffman Coding |
| 8: | 8-bit Scalar Quantization with Huffman Coding |
| . . . | . . . |
| 16: | 16-bit Scalar Quantization with Huffman Coding |

The quantization unit 52 may also perform predicted versions of any of the foregoing types of quantization modes, where a difference is determined between an element of (or a weight when vector quantization is performed) of the V-vector of a previous frame and the element (or weight when vector quantization is performed) of the V-vector of a current frame is determined. The quantization unit 52 may then quantize the difference between the elements or weights of the current frame and previous frame rather than the value of the element of the V-vector of the current frame itself.

The quantization unit 52 may perform multiple forms of quantization with respect to each of the reduced foreground V[k] vectors 55 to obtain multiple coded versions of the reduced foreground V[k] vectors 55. The quantization unit 52 may select the one of the coded versions of the reduced foreground V[k] vectors 55 as the coded foreground V[k] vector 57. The quantization unit 52 may, in other words, select one of the non-predicted vector-quantized V-vector, predicted vector-quantized V-vector, the non-Huffman-coded scalar-quantized V-vector, and the Huffman-coded scalar-quantized V-vector to use as the output switched-quantized V-vector based on any combination of the criteria discussed in this disclosure. In some examples, the quantization unit 52 may select a quantization mode from a set of quantization modes that includes a vector quantization mode and one or more scalar quantization modes, and quantize an input V-vector based on (or according to) the selected mode. The quantization unit 52 may then provide the selected one of the non-predicted vector-quantized V-vector (e.g., in terms of weight values or bits indicative thereof), predicted vector-quantized V-vector (e.g., in terms of error values or bits indicative thereof), the non-Huffman-coded scalar-quantized V-vector and the Huffman-coded scalar-quantized V-vector to the bitstream generation unit 52 as the coded foreground V[k] vectors 57. The quantization unit 52 may also provide the syntax elements indicative of the quantization mode (e.g., the NbitsQ syntax element) and any other syntax elements used to dequantize or otherwise reconstruct the V-vector.

The psychoacoustic audio coder unit 40 included within the audio encoding device 20 may represent multiple instances of a psychoacoustic audio coder, each of which is used to encode a different audio object or HOA channel of each of the energy compensated ambient HOA coefficients 47' and the interpolated nFG signals 49' to generate encoded ambient HOA coefficients 59 and encoded nFG signals 61. The psychoacoustic audio coder unit 40 may output the encoded ambient HOA coefficients 59 and the encoded nFG signals 61 to the bitstream generation unit 42.

The bitstream generation unit 42 included within the audio encoding device 20 represents a unit that formats data to conform to a known format (which may refer to a format known by a decoding device), thereby generating the vector-based bitstream 21. The bitstream 21 may, in other words, represent encoded audio data, having been encoded in the manner described above. The bitstream generation unit 42 may represent a multiplexer in some examples, which may receive the coded foreground V[k] vectors 57, the encoded ambient HOA coefficients 59, the encoded nFG signals 61 and the background channel information 43. The bitstream generation unit 42 may then generate a bitstream 21 based on the coded foreground V[k] vectors 57, the encoded ambient HOA coefficients 59, the encoded nFG signals 61 and the background channel information 43. In this way, the bitstream generation unit 42 may thereby specify the vectors 57 in the bitstream 21 to obtain the bitstream 21 as described below in more detail with respect to the example of FIG. 7.

The bitstream 21 may include a primary or main bitstream and one or more side channel bitstreams.

Although not shown in the example of FIG. 3, the audio encoding device 20 may also include a bitstream output unit that switches the bitstream output from the audio encoding device 20 (e.g., between the directional-based bitstream 21 and the vector-based bitstream 21) based on whether a current frame is to be encoded using the directional-based synthesis or the vector-based synthesis. The bitstream output unit may perform the switch based on the syntax element output by the content analysis unit 26 indicating whether a directional-based synthesis was performed (as a result of detecting that the HOA coefficients 11 were generated from a synthetic audio object) or a vector-based synthesis was performed (as a result of detecting that the HOA coefficients were recorded). The bitstream output unit may specify the correct header syntax to indicate the switch or current encoding used for the current frame along with the respective one of the bitstreams 21.

Moreover, as noted above, the soundfield analysis unit 44 may identify $BG_{TOT}$ ambient HOA coefficients 47, which may change on a frame-by-frame basis (although at times $BG_{TOT}$ may remain constant or the same across two or more adjacent (in time) frames). The change in $BG_{TOT}$ may result in changes to the coefficients expressed in the reduced foreground V[k] vectors 55. The change in $BG_{TOT}$ may result in background HOA coefficients (which may also be referred to as "ambient HOA coefficients") that change on a frame-by-frame basis (although, again, at times $BG_{TOT}$ may remain constant or the same across two or more adjacent (in time) frames). The changes often result in a change of energy for the aspects of the sound field represented by the addition or removal of the additional ambient HOA coefficients and the corresponding removal of coefficients from or addition of coefficients to the reduced foreground V[k] vectors 55.

As a result, the soundfield analysis unit 44 may further determine when the ambient HOA coefficients change from frame to frame and generate a flag or other syntax element indicative of the change to the ambient HOA coefficient in terms of being used to represent the ambient components of the sound field (where the change may also be referred to as a "transition" of the ambient HOA coefficient or as a "transition" of the ambient HOA coefficient). In particular, the coefficient reduction unit 46 may generate the flag (which may be denoted as an AmbCoeffTransition flag or an AmbCoeffIdxTransition flag), providing the flag to the bitstream generation unit 42 so that the flag may be included in the bitstream 21 (possibly as part of side channel information).

The coefficient reduction unit 46 may, in addition to specifying the ambient coefficient transition flag, also modify how the reduced foreground V[k] vectors 55 are generated. In one example, upon determining that one of the ambient HOA ambient coefficients is in transition during the current frame, the coefficient reduction unit 46 may specify, a vector coefficient (which may also be referred to as a "vector element" or "element") for each of the V-vectors of the reduced foreground V[k] vectors 55 that corresponds to the ambient HOA coefficient in transition. Again, the ambient HOA coefficient in transition may add or remove from the $BG_{TOT}$ total number of background coefficients. Therefore, the resulting change in the total number of background coefficients affects whether the ambient HOA coefficient is included or not included in the bitstream, and whether the corresponding element of the V-vectors are included for the V-vectors specified in the bitstream in the second and third configuration modes described above. More information regarding how the coefficient reduction unit 46 may specify the reduced foreground V[k] vectors 55 to overcome the changes in energy is provided in U.S. application Ser. No. 14/594,533, entitled "TRANSITIONING OF AMBIENT HIGHER ORDER AMBISONIC COEFFICIENTS," filed Jan. 12, 2015.

Figure 14:
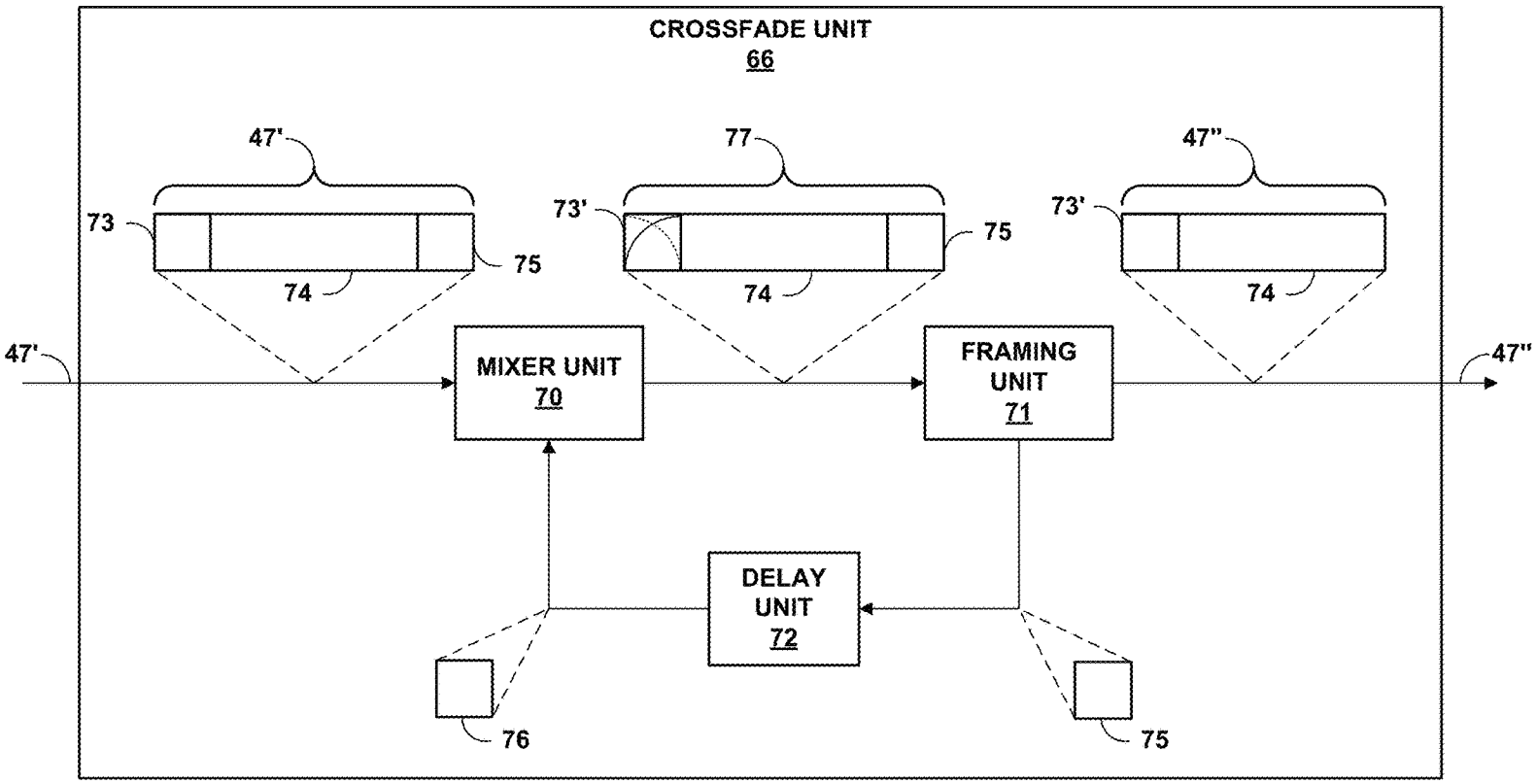
FIG. 14 is a block diagram illustrating, in more detail, the crossfade unit of the audio encoding device shown in the example of FIG. 3.

FIG. 14 is a block diagram illustrating, in more detail, the crossfade unit 66 of the audio encoding device 20 shown in the example of FIG. 3. The crossfade unit 66 may include a mixer unit 70, a framing unit 71, and a delay unit 72. FIG. 14 illustrates only one example of the crossfade unit 66 and other configurations are possible. For instance, the framing unit 71 may be positioned prior to the mixer unit 70 such that a third portion 75 is removed before the energy compensated ambient HOA coefficients 47' are received by the mixer unit 70.

The mixer unit 70 may represent a unit configured to combine a plurality of signals into a single signal. For instance, the mixer unit 70 may combine a first signal with a second signal generate a modified signal. The mixer unit 70 may combine the first signal with the second signal by fading the first signal in while fading the second signal out. The mixer unit 70 may apply any variety of functions to fade the portions in and out. As one example, the mixer unit 70 may apply a linear function to fade the first signal in and apply a linear function to fade the second signal out. As another example, the mixer unit 70 may apply an exponential function to fade the first signal in and apply an exponential function to fade the second signal out. In some examples, the mixer unit 70 may apply different functions to the signals. For instance, the mixer unit 70 may apply a linear function to fade the first signal in and apply an exponential to fade the second signal out. In some examples, the mixer unit 70 may fade a signal in or out by fading a portion of the signal in or out. In any case, mixer unit may output the modified signal to one or more other components of the crossfade unit 66, such as the framing unit 71.

The framing unit 71 may represent a unit configured to frame an input signal to fit one or more particular dimensions. In some examples, such as where one or more of the dimensions of the input signal are larger than one or more of the particular dimensions, the framing unit 71 may generate a framed output signal by removing a portion of the input signal, e.g., the portion that exceeds the particular dimensions. For instance, where the particular dimensions are 1024 by 4 and the input signal has dimensions of 1280 by 4, the framing unit 71 may generate the framed output signal by removing a 256 by 4 portion of the input signal. In some examples, the framing unit 71 may output the framed output signal to one or more other components of the audio encoding device 20, such as the psychoacoustic audio coder unit 40 of FIG. 3. In some examples, framing unit 71 may output the removed portion of the input signal to one or more other components of the crossfade unit 66, such as the delay unit 72.

The delay unit 72 may represent a unit configured to store a signal for later use. For instance, the delay unit 72 may be configured to store, at a first time, a first signal and output, at a second later time, the first signal. In this way, the delay unit 72 may operate as a first-in first-out (FIFO) buffer. The delay unit 72 may output, at the second later time, the first signal to one or more other components of the crossfade unit 66, such as the mixer unit 70.

As discussed above, the crossfade unit 66 may receive the energy compensated ambient HOA coefficients 47' of a current frame (e.g., frame k), crossfade the energy compensated ambient HOA coefficients 47' of the current frame with the energy compensated ambient HOA coefficients 47' of a previous frame, and output the crossfaded energy compensated ambient HOA coefficients 47". As illustrated in FIG. 14, the energy compensated ambient HOA coefficients 47' may include a first portion 73, a second portion 74, and a third portion 75.

In accordance with one or more techniques of this disclosure, the mixer unit 70 of the crossfade unit 66 may combine (e.g., crossfade between) the first portion 73 of the energy compensated ambient HOA coefficients 47' of the current frame and the third portion 76 of the energy compensated ambient HOA coefficients 47' of the previous frame to generate intermediate crossfaded energy compensated ambient HOA coefficients 77. The mixer unit 70 may output the generated intermediate crossfaded energy compensated ambient HOA coefficients 77 to the framing unit 71. As the mixer unit 70 utilizes the third portion 76 of the energy compensated ambient HOA coefficients 47' of the previous frame, in this example, it can be assumed that the crossfade unit 66 was in operation prior to processing the current frame. As such, as opposed to separately crossfading the US matrix of the current frame with the US matrix of the previous frame and the V matrix of the current frame with the V matrix of the previous frame, the mixer unit 70 may crossfade in the energy compensated domain. In this way, techniques according to the disclosure may reduce the computational load, power consumption, and/or complexity of the crossfade unit 66.

The framing unit 71 may determine the crossfaded energy compensated ambient HOA coefficients 47" by removing the third portion 75 from the intermediate crossfaded energy compensated ambient HOA coefficients 77 if the dimensions of the intermediate crossfaded energy compensated ambient HOA coefficients 77 exceed the dimensions of the current frame. For instance, where the dimensions for the current frame are 1024 by 4 and the dimension of the intermediate crossfaded energy compensated ambient HOA coefficients 77 are 1280 by 4, the framing unit 71 may determine the crossfaded energy compensated ambient HOA coefficients 47" by removing the third portion 75 (e.g., a 256 by 4 portion) from the intermediate crossfaded energy compensated ambient HOA coefficients 77. The framing unit 71 may output the third portion 75 to delay unit 72 for future use (e.g., by the mixer unit 70 when crossfading the energy compensated ambient HOA coefficients 47' of a subsequent frame). The framing unit 71 may output the determined crossfaded energy compensated ambient HOA coefficients 47" to the psychoacoustic audio coder unit 40 of FIG. 3. In this way, the crossfade unit 66 may smooth the transition between the previous frame and the current frame.

In some examples, the crossfade unit 66 may crossfade between any two sets of HOA coefficients. As one example, the crossfade unit 66 may crossfade between a first set of HOA coefficients and a second set of HOA coefficients. As another example, the crossfade unit 66 may crossfade between a current set of HOA coefficients and a previous set of HOA coefficients.

Figure 4:
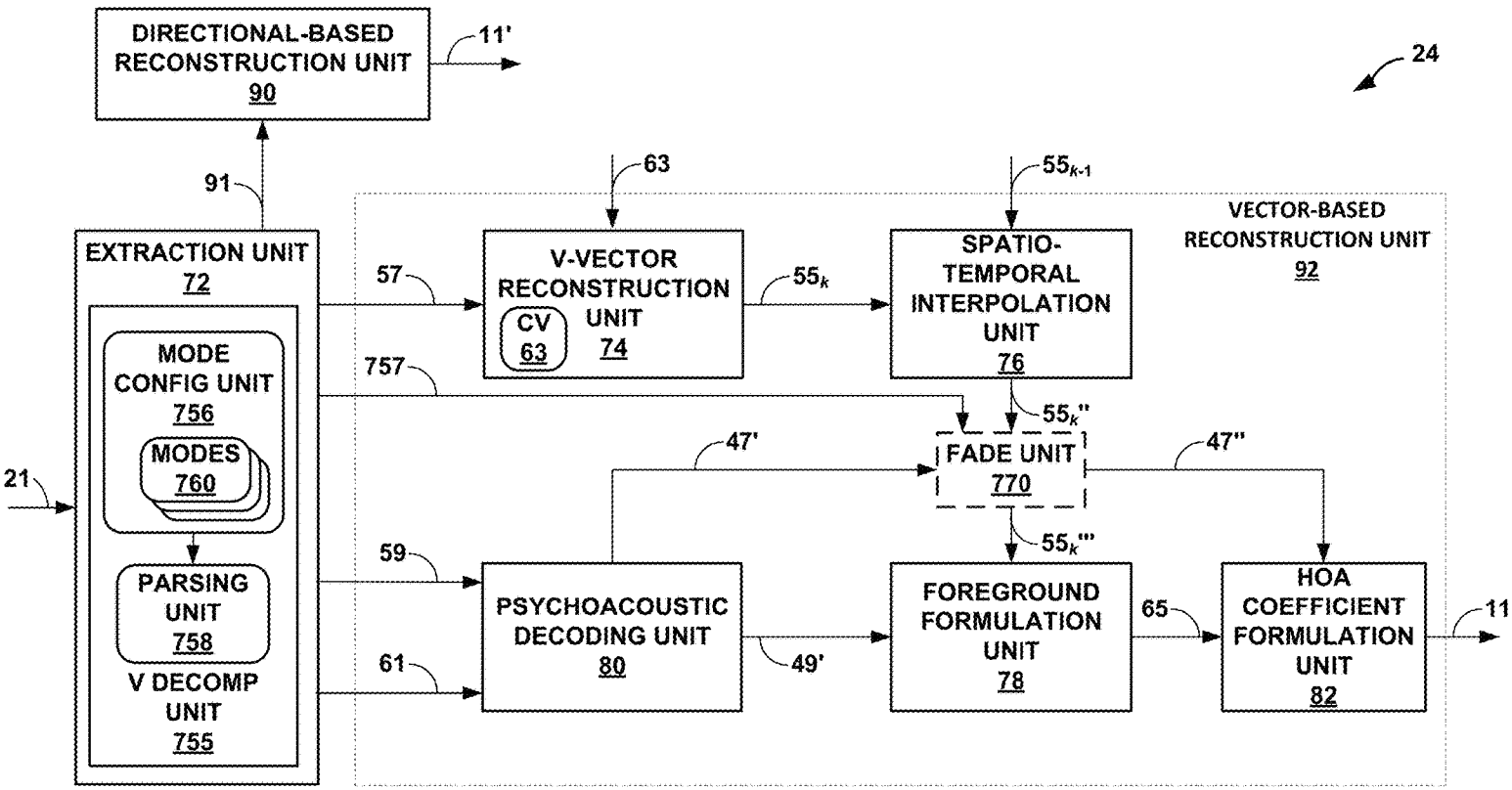
FIG. 4 is a block diagram illustrating the audio decoding device of FIG. 2 in more detail.

FIG. 4 is a block diagram illustrating the audio decoding device 24 of FIG. 2 in more detail. As shown in the example of FIG. 4 the audio decoding device 24 may include an extraction unit 72, a directionality-based reconstruction unit 90 and a vector-based reconstruction unit 92. Although described below, more information regarding the audio decoding device 24 and the various aspects of decompressing or otherwise decoding HOA coefficients is available in International Patent Application Publication No. WO 2014/194099, entitled "INTERPOLATION FOR DECOMPOSED REPRESENTATIONS OF A SOUND FIELD," filed 29 May 2014.

The extraction unit 72 may represent a unit configured to receive the bitstream 21 and extract the various encoded versions (e.g., a directional-based encoded version or a vector-based encoded version) of the HOA coefficients 11. The extraction unit 72 may determine from the above noted syntax element indicative of whether the HOA coefficients 11 were encoded via the various direction-based or vector-based versions. When a directional-based encoding was performed, the extraction unit 72 may extract the directional-based version of the HOA coefficients 11 and the syntax elements associated with the encoded version (which is denoted as directional-based information 91 in the example of FIG. 4), passing the directional based information 91 to the directional-based reconstruction unit 90. The directional-based reconstruction unit 90 may represent a unit configured to reconstruct the HOA coefficients in the form of HOA coefficients 11' based on the directional-based information 91.

When the syntax element indicates that the HOA coefficients 11 were encoded using a vector-based synthesis, the extraction unit 72 may extract the coded foreground V[k] vectors 57 (which may include coded weights 57 and/or indices 63 or scalar quantized V-vectors), the encoded ambient HOA coefficients 59 and the corresponding audio objects 61 (which may also be referred to as the encoded nFG signals 61). The audio objects 61 each correspond to one of the vectors 57. The extraction unit 72 may pass the coded foreground V[k] vectors 57 to the V-vector reconstruction unit 74 and the encoded ambient HOA coefficients 59 along with the encoded nFG signals 61 to the psychoacoustic decoding unit 80.

The V-vector reconstruction unit 74 may represent a unit configured to reconstruct the V-vectors from the encoded foreground V[k] vectors 57. The V-vector reconstruction unit 74 may operate in a manner reciprocal to that of the quantization unit 52.

The psychoacoustic decoding unit 80 may operate in a manner reciprocal to the psychoacoustic audio coder unit 40 shown in the example of FIG. 3 so as to decode the encoded ambient HOA coefficients 59 and the encoded nFG signals 61 and thereby generate energy compensated ambient HOA coefficients 47' and the interpolated nFG signals 49' (which may also be referred to as interpolated nFG audio objects 49'). The psychoacoustic decoding unit 80 may pass the energy compensated ambient HOA coefficients 47' to the fade unit 770 and the nFG signals 49' to the foreground formulation unit 78.

The spatio-temporal interpolation unit 76 may operate in a manner similar to that described above with respect to the spatio-temporal interpolation unit 50. The spatio-temporal interpolation unit 76 may receive the reduced foreground V[k] vectors $\mathbf{55}_k$ and perform the spatio-temporal interpolation with respect to the foreground V[k] vectors $\mathbf{55}_k$ and the reduced foreground V[k−1] vectors $\mathbf{55}_{k-1}$ to generate interpolated foreground V[k] vectors $\mathbf{55}_k$". The spatio-temporal interpolation unit 76 may forward the interpolated foreground V[k] vectors $\mathbf{55}_k$" to the fade unit 770.

The extraction unit 72 may also output a signal 757 indicative of when one of the ambient HOA coefficients is in transition to fade unit 770, which may then determine which of the $SHC_{BG}$ 47' (where the $SHC_{BG}$ 47' may also be denoted as "ambient HOA channels 47" or "ambient HOA coefficients 47') and the elements of the interpolated foreground V[k] vectors $\mathbf{55}_k$" are to be either faded-in or faded-out. In some examples, the fade unit 770 may operate opposite with respect to each of the ambient HOA coefficients 47' and the elements of the interpolated foreground V[k] vectors $\mathbf{55}_k''$. That is, the fade unit 770 may perform a fade-in or fade-out, or both a fade-in or fade-out with respect to corresponding one of the ambient HOA coefficients 47', while performing a fade-in or fade-out or both a fade-in and a fade-out, with respect to the corresponding one of the elements of the interpolated foreground V[k] vectors $\mathbf{55}_k''$. The fade unit 770 may output adjusted ambient HOA coefficients 47" to the HOA coefficient formulation unit 82 and adjusted foreground V[k] vectors $\mathbf{55}_k'''$ to the foreground formulation unit 78. In this respect, the fade unit 770 represents a unit configured to perform a fade operation with respect to various aspects of the HOA coefficients or derivatives thereof, e.g., in the form of the ambient HOA coefficients 47' and the elements of the interpolated foreground V[k] vectors $\mathbf{55}_k''$.

The foreground formulation unit 78 may represent a unit configured to perform matrix multiplication with respect to the adjusted foreground V[k] vectors $\mathbf{55}_k'''$ and the interpolated nFG signals 49' to generate the foreground HOA coefficients 65. In this respect, the foreground formulation unit 78 may combine the audio objects 49' (which is another way by which to denote the interpolated nFG signals 49') with the vectors $\mathbf{55}_k'''$ to reconstruct the foreground or, in other words, predominant aspects of the HOA coefficients 11'. The foreground formulation unit 78 may perform a matrix multiplication of the interpolated nFG signals 49' by the adjusted foreground V[k] vectors $\mathbf{55}_k'''$.

The HOA coefficient formulation unit 82 may represent a unit configured to combine the foreground HOA coefficients 65 to the adjusted ambient HOA coefficients 47" so as to obtain the HOA coefficients 11'. The prime notation reflects that the HOA coefficients 11' may be similar to but not the same as the HOA coefficients 11. The differences between the HOA coefficients 11 and 11' may result from loss due to transmission over a lossy transmission medium, quantization or other lossy operations.

Figure 5:
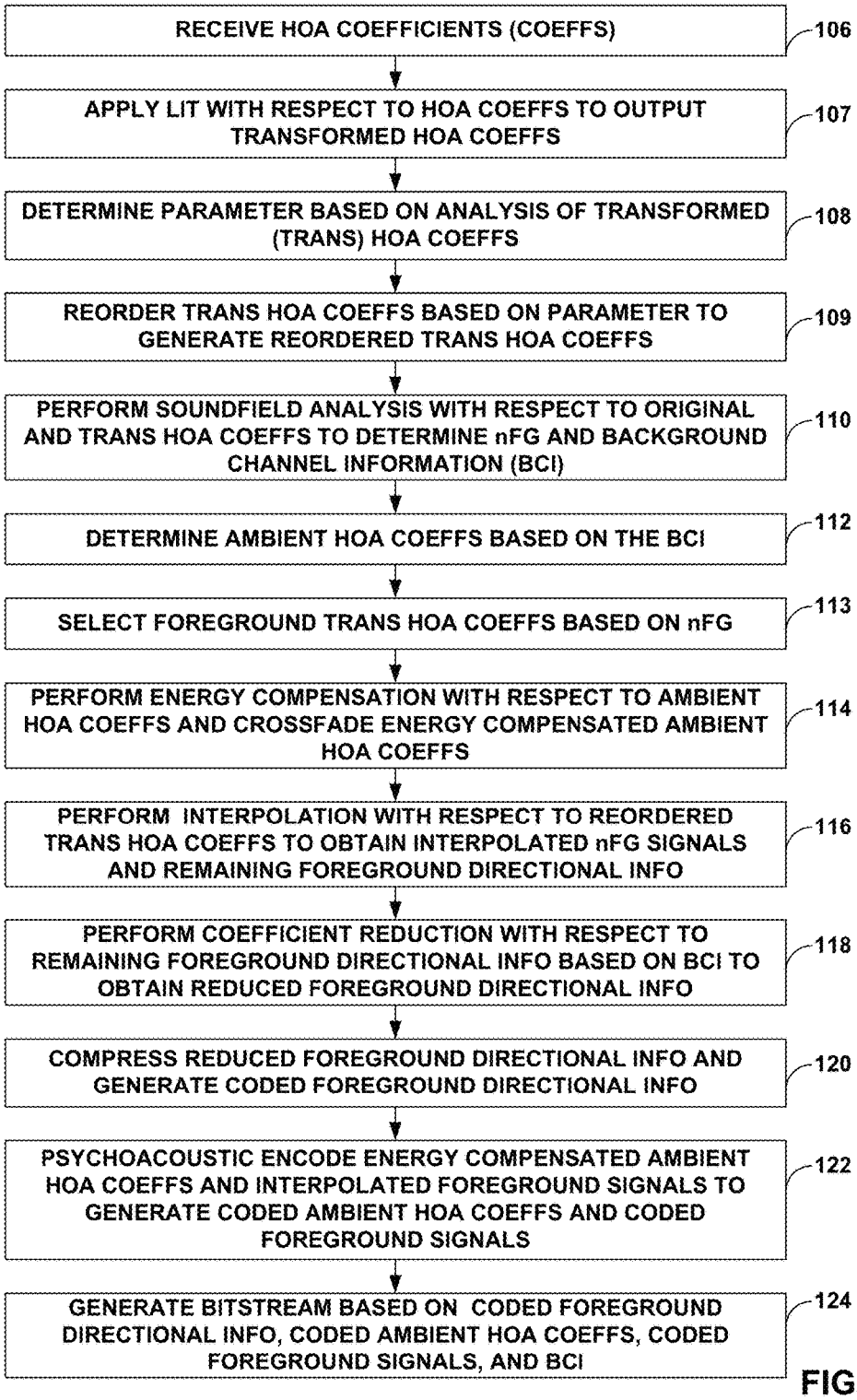
FIG. 5 is a flowchart illustrating exemplary operation of an audio encoding device in performing various aspects of the vector-based synthesis techniques described in this disclosure.

FIG. 5 is a flowchart illustrating exemplary operation of an audio encoding device, such as the audio encoding device 20 shown in the example of FIG. 3, in performing various aspects of the vector-based synthesis techniques described in this disclosure. Initially, the audio encoding device 20 receives the HOA coefficients 11 (106). The audio encoding device 20 may invoke the LIT unit 30, which may apply a LIT with respect to the HOA coefficients to output transformed HOA coefficients (e.g., in the case of SVD, the transformed HOA coefficients may comprise the US[k] vectors 33 and the V[k] vectors 35) (107).

The audio encoding device 20 may next invoke the parameter calculation unit 32 to perform the above described analysis with respect to any combination of the US[k] vectors 33, US[k−1] vectors 33, the V[k] and/or V[k−1] vectors 35 to identify various parameters in the manner described above. That is, the parameter calculation unit 32 may determine at least one parameter based on an analysis of the transformed HOA coefficients 33/35 (108).

The audio encoding device 20 may then invoke the reorder unit 34, which may reorder the transformed HOA coefficients (which, again in the context of SVD, may refer to the US[k] vectors 33 and the V[k] vectors 35) based on the parameter to generate reordered transformed HOA coefficients 33'/35' (or, in other words, the US[k] vectors 33' and the V[k] vectors 35'), as described above (109). The audio encoding device 20 may, during any of the foregoing operations or subsequent operations, also invoke the soundfield analysis unit 44. The soundfield analysis unit 44 may, as described above, perform a soundfield analysis with respect to the HOA coefficients 11 and/or the transformed HOA coefficients 33/35 to determine the total number of foreground channels (nFG) 45, the order of the background soundfield ($N_{BG}$) and the number (nBGa) and indices (i) of additional BG HOA channels to send (which may collectively be denoted as background channel information 43 in the example of FIG. 3) (109).

The audio encoding device 20 may also invoke the background selection unit 48. The background selection unit 48 may determine background or ambient HOA coefficients 47 based on the background channel information 43 (110). The audio encoding device 20 may further invoke the foreground selection unit 36, which may select the reordered US[k] vectors 33' and the reordered V[k] vectors 35' that represent foreground or distinct components of the soundfield based on nFG 45 (which may represent a one or more indices identifying the foreground vectors) (112).

The audio encoding device 20 may invoke the energy compensation unit 38. The energy compensation unit 38 may perform energy compensation with respect to the ambient HOA coefficients 47 to compensate for energy loss due to removal of various ones of the HOA coefficients by the background selection unit 48 and crossfade energy compensated ambient HOA coefficients 47' in the manner described above (114).

The audio encoding device 20 may also invoke the spatio-temporal interpolation unit 50. The spatio-temporal interpolation unit 50 may perform spatio-temporal interpolation with respect to the reordered transformed HOA coefficients 33'/35' to obtain the interpolated foreground signals 49' (which may also be referred to as the "interpolated nFG signals 49") and the remaining foreground directional information 53 (which may also be referred to as the "V[k] vectors 53") (116). The audio encoding device 20 may then invoke the coefficient reduction unit 46. The coefficient reduction unit 46 may perform coefficient reduction with respect to the remaining foreground V[k] vectors 53 based on the background channel information 43 to obtain reduced foreground directional information 55 (which may also be referred to as the reduced foreground V[k] vectors 55) (118).

The audio encoding device 20 may then invoke the quantization unit 52 to compress, in the manner described above, the reduced foreground V[k] vectors 55 and generate coded foreground V[k] vectors 57 (120).

The audio encoding device 20 may also invoke the psychoacoustic audio coder unit 40. The psychoacoustic audio coder unit 40 may psychoacoustic code each vector of the energy compensated ambient HOA coefficients 47' and the interpolated nFG signals 49' to generate encoded ambient HOA coefficients 59 and encoded nFG signals 61. The audio encoding device may then invoke the bitstream generation unit 42. The bitstream generation unit 42 may generate the bitstream 21 based on the coded foreground directional information 57, the coded ambient HOA coefficients 59, the coded nFG signals 61 and the background channel information 43.

Figure 6:
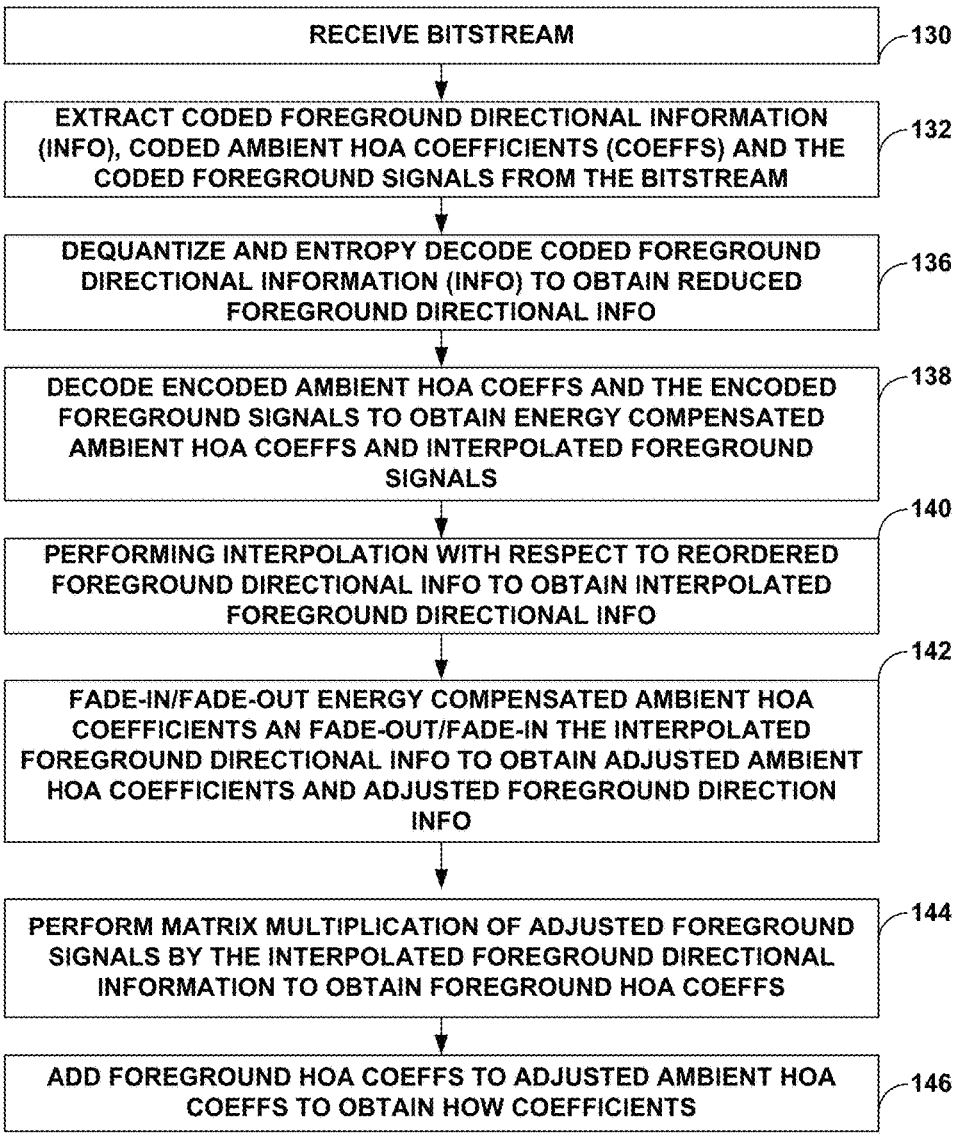
FIG. 6 is a flowchart illustrating exemplary operation of an audio decoding device in performing various aspects of the techniques described in this disclosure.

FIG. 6 is a flowchart illustrating exemplary operation of an audio decoding device, such as the audio decoding device 24 shown in FIG. 4, in performing various aspects of the techniques described in this disclosure. Initially, the audio decoding device 24 may receive the bitstream 21 (130). Upon receiving the bitstream, the audio decoding device 24 may invoke the extraction unit 72. Assuming for purposes of discussion that the bitstream 21 indicates that vector-based reconstruction is to be performed, the extraction unit 72 may parse the bitstream to retrieve the above noted information, passing the information to the vector-based reconstruction unit 92.

In other words, the extraction unit 72 may extract the coded foreground directional information 57 (which, again, may also be referred to as the coded foreground V[k] vectors 57), the coded ambient HOA coefficients 59 and the coded foreground signals (which may also be referred to as the coded foreground nFG signals 59 or the coded foreground audio objects 59) from the bitstream 21 in the manner described above (132).

The audio decoding device 24 may further invoke the dequantization unit 74. The dequantization unit 74 may entropy decode and dequantize the coded foreground directional information 57 to obtain reduced foreground directional information $\mathbf{55}_k$ (136). The audio decoding device 24 may also invoke the psychoacoustic decoding unit 80. The psychoacoustic audio decoding unit 80 may decode the encoded ambient HOA coefficients 59 and the encoded foreground signals 61 to obtain energy compensated ambient HOA coefficients 47' and the interpolated foreground signals 49' (138). The psychoacoustic decoding unit 80 may pass the energy compensated ambient HOA coefficients 47' to the fade unit 770 and the nFG signals 49' to the foreground formulation unit 78.

The audio decoding device 24 may next invoke the spatio-temporal interpolation unit 76. The spatio-temporal interpolation unit 76 may receive the reordered foreground directional information $\mathbf{55}_k'$ and perform the spatio-temporal interpolation with respect to the reduced foreground directional information $\mathbf{55}_k/\mathbf{55}_{k-1}$ to generate the interpolated foreground directional information $\mathbf{55}_k''$ (140). The spatio-temporal interpolation unit 76 may forward the interpolated foreground V[k] vectors $\mathbf{55}_k''$ to the fade unit 770.

The audio decoding device 24 may invoke the fade unit 770. The fade unit 770 may receive or otherwise obtain syntax elements (e.g., from the extraction unit 72) indicative of when the energy compensated ambient HOA coefficients 47' are in transition (e.g., the AmbCoeffTransition syntax element). The fade unit 770 may, based on the transition syntax elements and the maintained transition state information, fade-in or fade-out the energy compensated ambient HOA coefficients 47' outputting adjusted ambient HOA coefficients 47" to the HOA coefficient formulation unit 82. The fade unit 770 may also, based on the syntax elements and the maintained transition state information, and fade-out or fade-in the corresponding one or more elements of the interpolated foreground V[k] vectors $\mathbf{55}_k''$ outputting the adjusted foreground V[k] vectors $\mathbf{55}_k'''$ to the foreground formulation unit 78 (142).

The audio decoding device 24 may invoke the foreground formulation unit 78. The foreground formulation unit 78 may perform matrix multiplication the nFG signals 49' by the adjusted foreground directional information $\mathbf{55}_k'''$ to obtain the foreground HOA coefficients 65 (144). The audio decoding device 24 may also invoke the HOA coefficient formulation unit 82. The HOA coefficient formulation unit 82 may add the foreground HOA coefficients 65 to adjusted ambient HOA coefficients 47" so as to obtain the HOA coefficients 11' (146).

Figure 7:
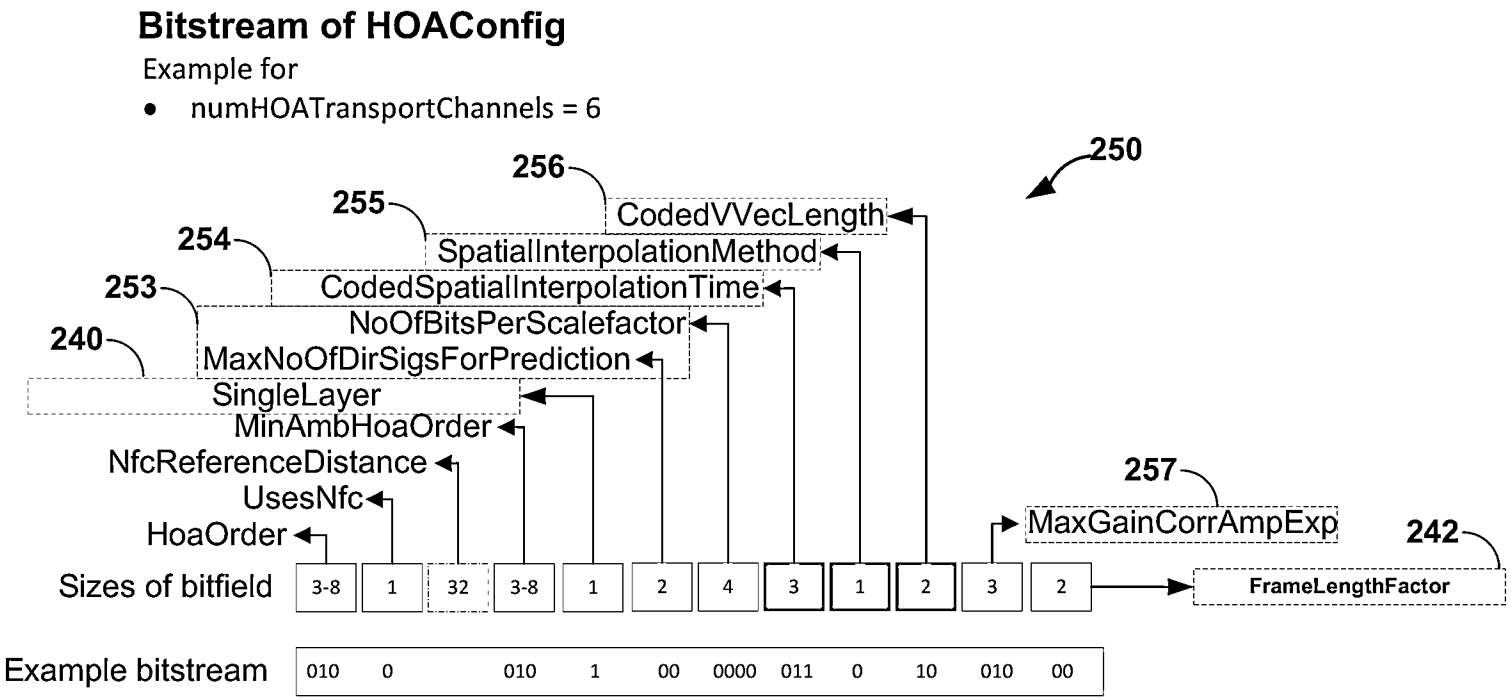
FIGS. 7 and 8 are diagrams illustrating, in more detail, the bitstream that may specify the compressed spatial components.

FIG. 7 is a diagram illustrating a portion 250 of the bitstream 21 shown in the example of FIGS. 2-4. The portion 250 shown in the example of FIG. 7, may be referred to as an HOAConfig portion 250 of the bitstream 21 and includes an HOAOrder field, a MinAmbHoaOrder field, the direction info field 253, the CodedSpatialInterpolationTime field 254, the SpatialInterpolationMethod field 255, the CodedVVecLength field 256 and the gain info field 257. As shown in the example of FIG. 7, the CodedSpatialInterpolationTime field 254 may comprise a three bit field, the SpatialInterpolationMethod field 255 may comprise a one bit field, and the CodedVVecLength field 256 may comprise two bit field.

The portion 250 also includes a SingleLayer field 240 and a FrameLengthFactor field 242. The SingleLayer field 240 may represent one or more bits indicative of whether multiple layers are used to represent the coded version of the HOA coefficients or whether a single layer is used to represent the coded version of the HOA coefficients. The FramelengthFactor field 242 represents one or more bits indicative of a frame length factor, which is discussed in more detail below with respect to FIG. 12.

Figure 8:
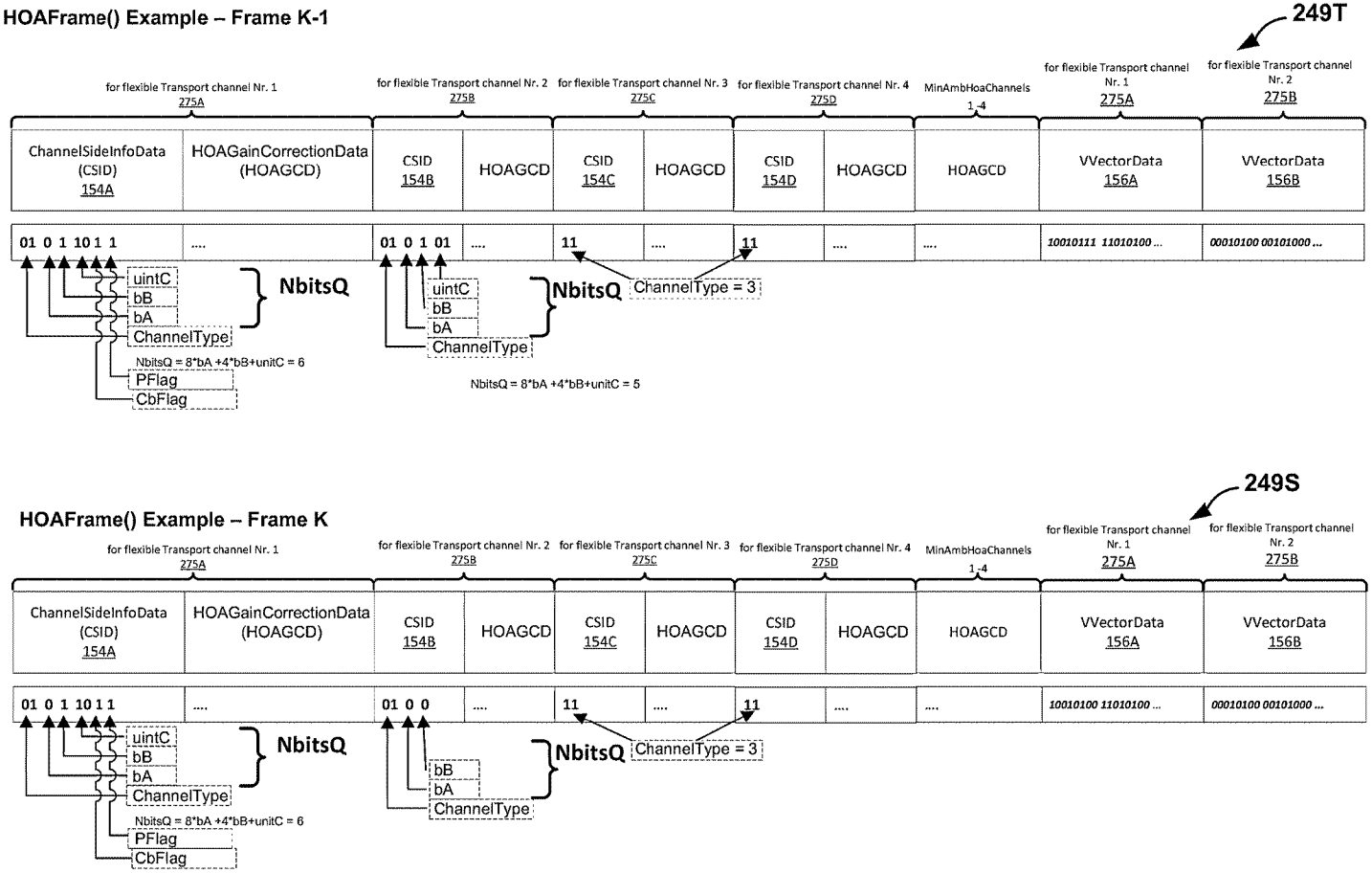

FIG. 8 is a diagram illustrating example frames 249S and 249T specified in accordance with various aspects of the techniques described in this disclosure. In the example of FIG. 8, frames 249S and 249T each include four transport channels 275A-275D. The transport channel 275A includes a header bits indicative of ChannelSideInfoData 154A and HOAGainCorrectionData. The transport channel 275A also includes a payload bits indicative of VVectorData 156A. The transport channel 275B includes a header bits indicative of ChannelSideInfoData 154B and HOAGainCorrectionData. The transport channel 275B also includes a payload bits indicative of VVectorData 156B. The transport channels 275C and 275D are not utilized for the frame 249S. The frame 275T is substantially similar to the frame 249S in terms of transport channels 275A-275D.

Figure 9:
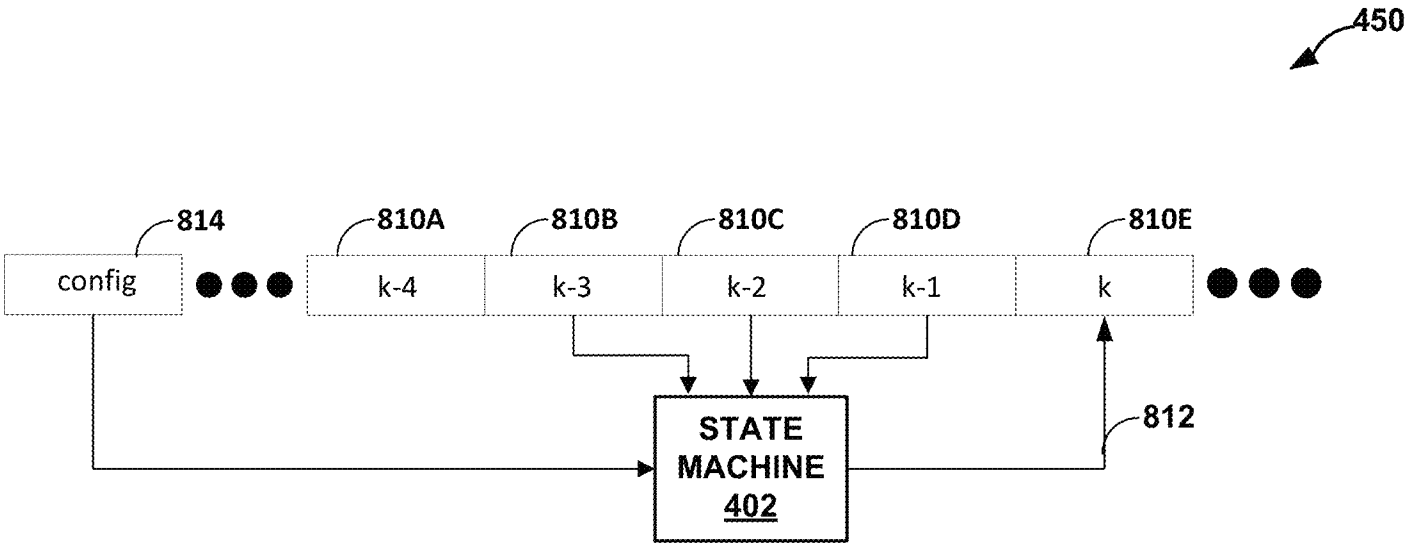
FIG. 9 is a diagram illustrating a portion of the bitstream that may specify the compressed spatial components in more detail.

FIG. 9 is a diagram illustrating example frames for one or more channels of at least one bitstream in accordance with techniques described herein. The bitstream 450 includes frames 810A-810H that may each include one or more channels. The bitstream 450 may be one example of the bitstream 21 shown in the example of FIG. 9. In the example of FIG. 9, the audio decoding device 24 maintains state information, updating the state information to determine how to decode the current frame k. The audio decoding device 24 may utilize state information from config 814, and frames 810B-810D.

In other words, the audio encoding device 20 may include, within the bitstream generation unit 42 for example, the state machine 402 that maintains state information for encoding each of frames 810A-810E in that the bitstream generation unit 42 may specify syntax elements for each of frames 810A-810E based on the state machine 402.

The audio decoding device 24 may likewise include, within the bitstream extraction unit 72 for example, a similar state machine 402 that outputs syntax elements (some of which are not explicitly specified in the bitstream 21) based on the state machine 402. The state machine 402 of the audio decoding device 24 may operate in a manner similar to that of the state machine 402 of the audio encoding device 20. As such, the state machine 402 of the audio decoding device 24 may maintain state information, updating the state information based on the config 814 and, in the example of FIG. 9, the decoding of the frames 810B-810D. Based on the state information, the bitstream extraction unit 72 may extract the frame 810E based on the state information maintained by the state machine 402. The state information may provide a number of implicit syntax elements that the audio encoding device 20 may utilize when decoding the various transport channels of the frame 810E.

Figure 10:
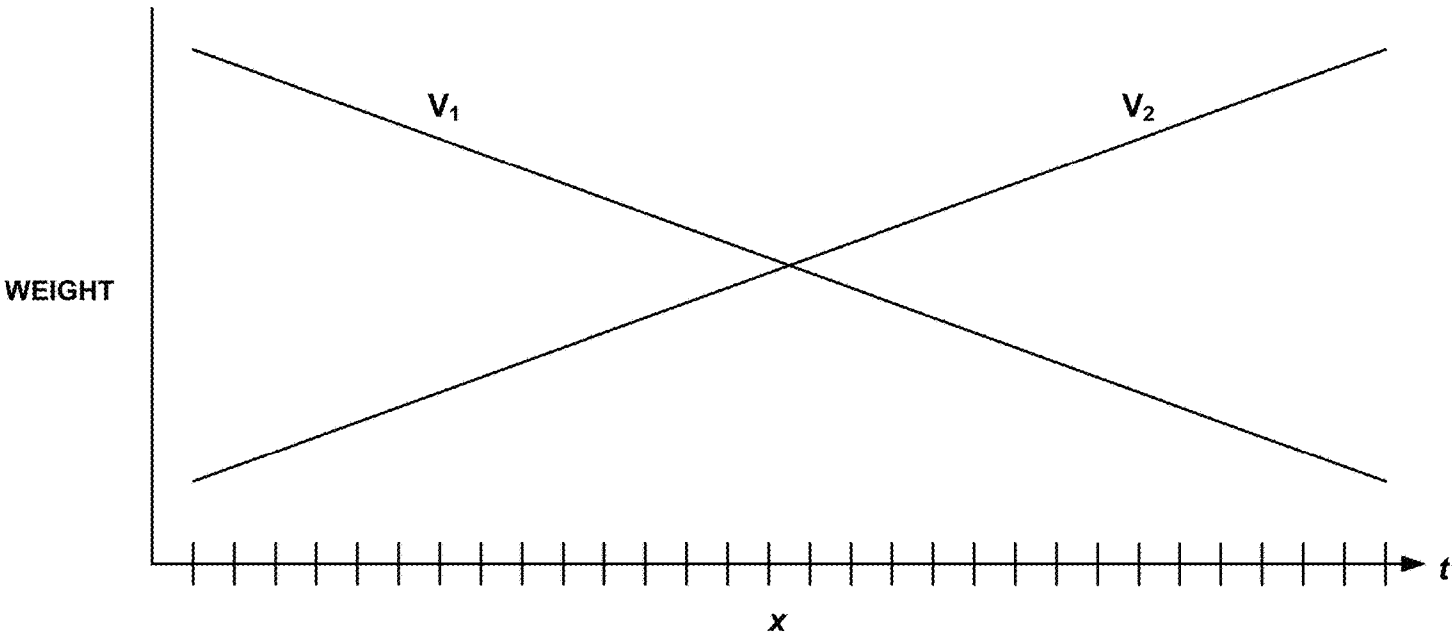
FIG. 10 illustrates a representation of techniques for obtaining a spatio-temporal interpolation as described herein.

FIG. 10 illustrates a representation of techniques for obtaining a spatio-temporal interpolation as described herein. The spatio-temporal interpolation unit 50 of the audio encoding device 20 shown in the example of FIG. 3 may perform the spatio-temporal interpolation described below in more detail. The spatio-temporal interpolation may include obtaining higher-resolution spatial components in both the spatial and time dimensions. The spatial components may be based on an orthogonal decomposition of a multi-dimensional signal comprised of higher-order ambisonic (HOA) coefficients (or, as HOA coefficients may also be referred, "spherical harmonic coefficients").

In the illustrated graph, vectors $V_1$ and $V_2$ represent corresponding vectors of two different spatial components of a multi-dimensional signal. The spatial components may be obtained by a block-wise decomposition of the multi-dimensional signal. In some examples, the spatial components result from performing a block-wise form of SVD with respect to each block (which may refer to a frame) of higher-order ambisonics (HOA) audio data (where this ambisonics audio data includes blocks, samples or any other form of multi-channel audio data). A variable M may be used to denote the length of an audio frame in samples.

Accordingly, $V_1$ and $V_2$ may represent corresponding vectors of the foreground V[k] vectors $\mathbf{51}_k$ and the foreground V[k−1] vectors $\mathbf{51}_{k-1}$ for sequential blocks of the HOA coefficients 11. $V_1$ may, for instance, represent a first vector of the foreground V[k−1] vectors $\mathbf{51}_{k-1}$ for a first frame (k−1), while $V_2$ may represent a first vector of a foreground V[k] vectors $\mathbf{51}_k$ for a second and subsequent frame (k). $V_1$ and $V_2$ may represent a spatial component for a single audio object included in the multi-dimensional signal.

Interpolated vectors $V_x$ for each x is obtained by weighting $V_1$ and $V_2$ according to a number of time segments or "time samples", x, for a temporal component of the multi-dimensional signal to which the interpolated vectors $V_x$ may be applied to smooth the temporal (and, hence, in some cases the spatial) component. Assuming an SVD composition, as described above, smoothing the nFG signals 49 may be obtained by doing a vector division of each time sample vector (e.g., a sample of the HOA coefficients 11) with the corresponding interpolated $V_x$. That is, $US[n]=HOA[n]*V_x[n]^{-1}$, where this represents a row vector multiplied by a column vector, thus producing a scalar element for US. $V_x[n]^{-1}$ may be obtained as a pseudoinverse of $V_x[n]$.

With respect to the weighting of $V_1$ and $V_2$, $V_1$ is weighted proportionally lower along the time dimension due to the $V_2$ occurring subsequent in time to $V_1$. That is, although the foreground V[k−1] vectors $\mathbf{51}_{k-1}$ are spatial components of the decomposition, temporally sequential foreground V[k] vectors $\mathbf{51}_k$ represent different values of the spatial component over time. Accordingly, the weight of $V_1$ diminishes while the weight of $V_2$ grows as x increases along t. Here, $d_1$ and $d_2$ represent weights.

Figure 11:
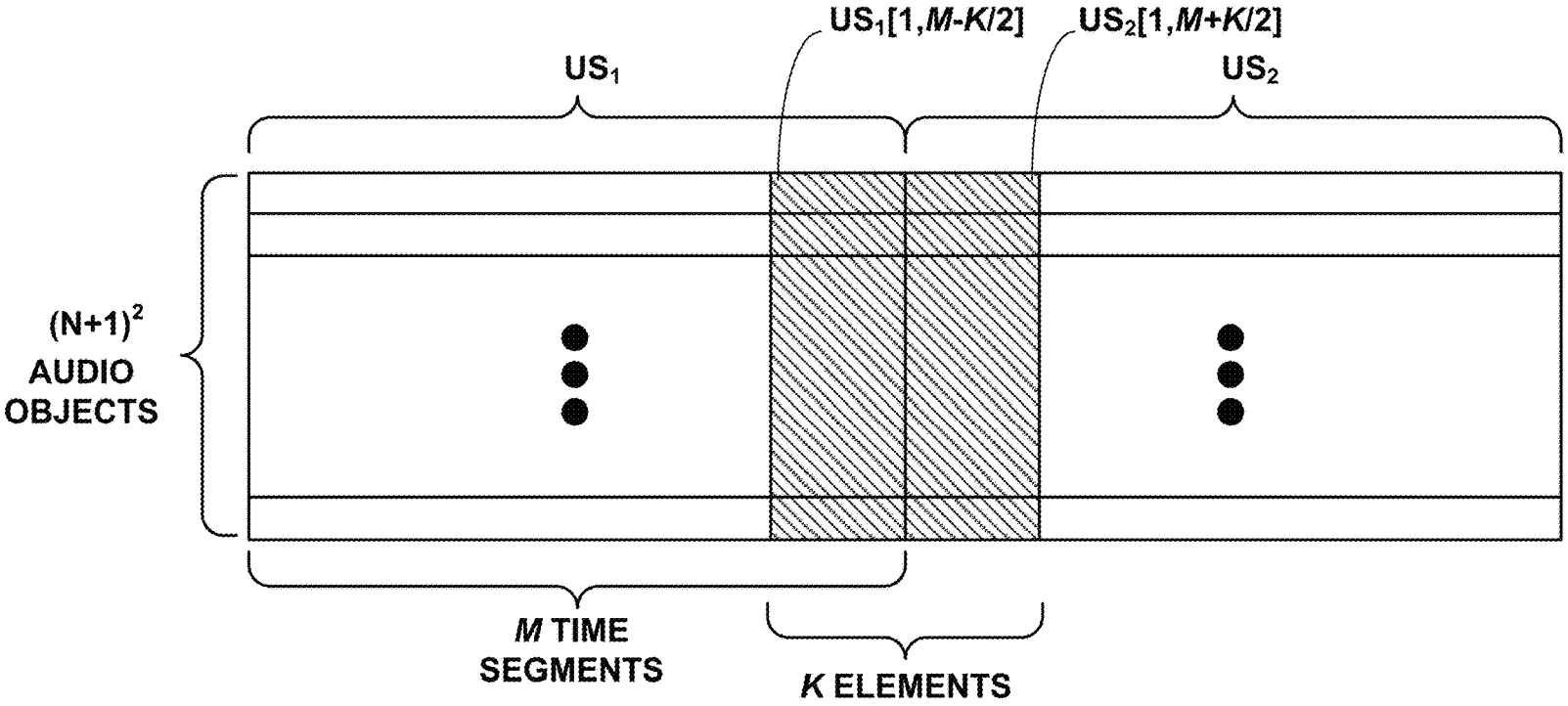
FIG. 11 is a block diagram illustrating artificial US matrices, $US_1$ and $US_2$, for sequential SVD blocks for a multi-dimensional signal according to techniques described herein.

FIG. 11 is a block diagram illustrating artificial US matrices, $US_1$ and $US_2$, for sequential SVD blocks for a multi-dimensional signal according to techniques described herein. Interpolated V-vectors may be applied to the row vectors of the artificial US matrices to recover the original multi-dimensional signal. More specifically, the spatio-temporal interpolation unit 50 may multiply the pseudo-inverse of the interpolated foreground V[k] vectors 53 to the result of multiplying nFG signals 49 by the foreground V[k] vectors $\mathbf{51}_k$ (which may be denoted as foreground HOA coefficients) to obtain K/2 interpolated samples, which may be used in place of the K/2 samples of the nFG signals as the first K/2 samples as shown in the example of FIG. 11 of the $U_2$ matrix.

Figure 12:
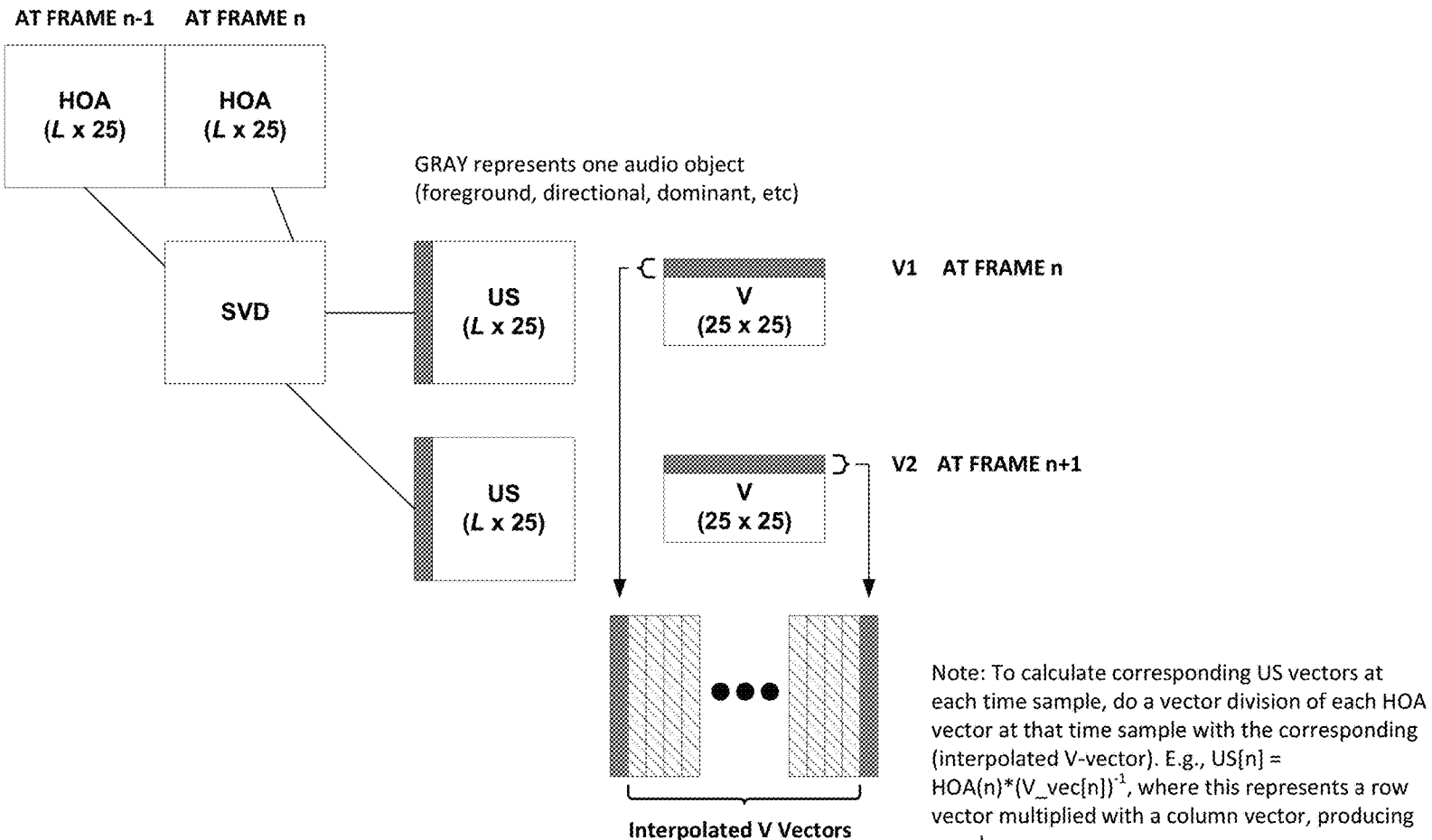
FIG. 12 is a block diagram illustrating decomposition of subsequent frames of a higher-order ambisonics (HOA) signal using Singular Value Decomposition and smoothing of the spatio-temporal components according to techniques described in this disclosure.

FIG. 12 is a block diagram illustrating decomposition of subsequent frames of a higher-order ambisonics (HOA) signal using Singular Value Decomposition and smoothing of the spatio-temporal components according to techniques described in this disclosure. Frame n−1 and frame n (which may also be denoted as frame n and frame n+1) represent subsequent frames in time, with each frame comprising 1024 time segments and having HOA order of 4, giving $(4+1)^2=25$ coefficients. US-matrices that are artificially smoothed U-matrices at frame n−1 and frame n may be obtained by application of interpolated V-vectors as illustrated. Each gray row or column vectors represents one audio object.

Compute HOA Representation of Active Vector Based Signals

The instantaneous CVECk is created by taking each of the vector based signals represented in XVECk and multiplying it with its corresponding (dequantized) spatial vector, VVECk. Each VVECk is represented in MVECk. Thus, for an order N HOA signal, and M vector based signals, there will be M vector based signals, each of which will have dimension given by the frame-length, P. These signals can thus be represented as: XVECkmn, n=0, . . . P−1; m=0, . . . M−1. Correspondingly, there will be M spatial vectors, VVECk of dimension $(N+1)^2$. These can be represented as MVECkml, l=0, . . . , $(N+1)^{2-1}$; m=0, . . . , M−1. The HOA representation for each vector based signal, CVECkm, is a matrix vector multiplication given by:

$$CVECkm=(XVECkm(MVECkm)T)T$$

which, produces a matrix of $(N+1)^2$ by P. The complete HOA representation is given by summing the contribution of each vector based signal as follows:

$$CVECk=m=0M-1CVECk[m]$$

Spatio-Temporal Interpolation of V-Vectors

However, in order to maintain smooth spatio-temporal continuity, the above computation is only carried out for part of the frame-length, P-B. The firstB samples of a HOA matrix, are instead carried out by using an interpolated set of MVECkml, m=0, . . . , M−1; l=0, . . . , $(N+1)^2$, derived from the current MVECkm and previous values MVECk−1m. This results in a higher time density spatial vector as we derive a vector for each time sample, p, as follows:

$$MVECkmp=pB-1MVECkm+B-1-pB-1MVECk-1m,\quad p=0,\ldots,B-1.$$

For each time sample, p, a new HOA vector of (N+1)2 dimension is computed as:

$$CVECkp=(XVECkmp)MVECkmp,\ p=0,\ldots,B-1$$

These, firstB samples are augmented with the P-B samples of the previous section to result in the complete HOA representation, CVECkm, of the mth vector based signal.

At the decoder (e.g., the audio decoding device 24 shown in the example of FIG. 5), for certain distinct, foreground, or Vector-based-predominant sound, the V-vector from the previous frame and the V-vector from the current frame may be interpolated using linear (or non-linear) interpolation to produce a higher-resolution (in time) interpolated V-vector over a particular time segment. The spatio temporal interpolation unit 76 may perform this interpolation, where the spatio-temporal interpolation unit 76 may then multiple the US vector in the current frame with the higher-resolution interpolated V-vector to produce the HOA matrix over that particular time segment.

Alternatively, the spatio-temporal interpolation unit 76 may multiply the US vector with the V-vector of the current frame to create a first HOA matrix. The decoder may additionally multiply the US vector with the V-vector from the previous frame to create a second HOA matrix. The spatio-temporal interpolation unit 76 may then apply linear (or non-linear) interpolation to the first and second HOA matrices over a particular time segment. The output of this interpolation may match that of the multiplication of the US vector with an interpolated V-vector, provided common input matrices/vectors.

In some examples, the size of the time segment for which interpolation is to be performed may vary as a function of the frame length. In other words, the audio encoding device 20 may be configured to operate with respect to a certain frame length or configurable to operate with respect to a number of different frame lengths. Example frame lengths that the audio encoding device 20 may support include 768, 1024, 2048 and 4096. The different frame lengths may result in different sets of possible time segment lengths (where a time segment may be specified in terms of the number of samples). The following table specifies different sets of possible time segments lengths that vary as a function of the frame length (which may be denoted by the variable L).

| | CodedSpatialInterpolationTime | | | | | | | |
|---|---|---|---|---|---|---|---|---|
| L | 0 | 1 | 2 | 3 | 4 | 5 | 6 | 7 |
| 768 | 0 | 32 | 64 | 128 | 256 | 384 | 512 | 768 |
| 1024 | 0 | 64 | 128 | 256 | 384 | 512 | 768 | 1024 |
| 2048 | 0 | 128 | 256 | 512 | 768 | 1024 | 1536 | 2048 |
| 4096 | 0 | 256 | 512 | 1024 | 1536 | 2048 | 3072 | 4096 |

In the foregoing table, the syntax element "CodedSpatialInterpolationTime" represents one or more bits indicative of a spatial interpolation time. The variable L denotes the frame length, as noted above. For a frame length of 768, the possible time segment lengths are defined by, in this example, the set of 0, 32, 64, 128, 256, 384, 512 and 768. The one value used for the current frame is specified by the value of the CodedSpatialInterpolationTime syntax element, where a value of zero indicates a time segment length of 0, a value of one indicates a time segment length of 32 and so on. For a frame length of 1024, the possible time segment lengths are defined, in this example, by the set of 0, 64, 128, 256, 384, 512, 768, and 1024. The one value used for the current frame is specified by the value of the CodedSpatialInterpolationTime syntax element, where a value of zero indicates a time segment length of 0, a value of one indicates a time segment length of 64 and so on. For a frame length of 2048, the possible time segment lengths are defined by the set of 0, 128, 256, 512, 768, 1024, 1536, and 2048. The one value used for the current frame is specified by the value of the CodedSpatialInterpolationTime syntax element, where a value of zero indicates a time segment length of 0, a value of one indicates a time segment length of 128 and so on. For a frame length of 4096, the possible time segment lengths are defined by, in this example, the set of 0, 256, 512, 1024, 1536, 2048, 3072, and 4096. The one value used for the current frame is specified by the value of the CodedSpatialInterpolationTime syntax element, where a value of zero indicates a time segment length of 0, a value of one indicates a time segment length of 256 and so on.

The spatio-temporal interpolation unit 50 of the audio encoding device 20 may perform the interpolation with respect to a number of different time segments selected form the corresponding set identified by the frame length, L. The spatio-temporal interpolation unit 50 may select the time segment that sufficiently smoothes the transition across the frame boundary (e.g., in terms of a signal to noise ratio) and that requires the least number of samples (given that interpolation may be a relatively expensive operation in terms of power, complexity, operations, etc.).

The spatio-temporal interpolation unit 50 may obtain the frame length, L, in any number of different ways. In some examples, the audio encoding device 20 is configured with a pre-set frame rate (which may be hard coded or, in other words, configured statically or manually configured as part of configuring the audio encoding device 20 to encode the HOA coefficients 11). In some examples, the audio encoding device 20 may specify the frame length based on a core coder frame length of the psychoacoustic audio coder unit 40. More information regarding the core coder frame length may be found with regard to discussions of a "coreCoderFrameLength" in ISO/IEC 23003-3:2012, entitled "Information technology—MPEG audio technologies—Part 3: Unified speech and audio coding."

When determined based on the core coder frame length, the audio encoding device 20 may reference the following table:

TABLE

| FrameLengthFactor definition | | | | |
|---|---|---|---|---|
| Core Coder | FrameLengthFactor | | | |
| Frame Length | 00 | 01 | 10 | 11 |
| | $C_{FrameLength}$ | | | |
| 768 | 1 | 1 | 1 | Reserved |
| 1024 | 1 | 1 | 1 | |
| 2048 | 1 | 1/2 | 1/2 | |
| 4096 | 1 | 1/2 | 1/4 | |

In the foregoing table, the audio encoding device 20 may set one or more bits (denoted by the syntax element "FrameLengthFactor") indicating the factor by which to multiple the core coder frame length, which is specified in the first column of the above table. The audio encoding device 20 may select one of the frame length factors of 1, ½ and ¼ based on various coding criteria or may select one of the factors based on attempts at coding frames at each of the various factors. The audio encoding device 20 may for example determine that the core coder frame length is 4096 and select a frame length factor of 1, ½ or ¼. The audio encoding device 20 may signal the frame length factor in an HOAConfig portion of the bitstream 21 (as shown above with respect to the example of FIG. 7), where a value of 00 (binary) indicates a frame length factor of 1, a value of 01 (binary) indicates a frame length factor of ½, and a value of 10 (binary) indicates a frame length factor of ¼. The audio encoding device 20 may also determine the frame length L as the core coder frame length multiplied by the frame length factor (e.g., 1, ½, or ¼).

In this respect, the audio encoding device 20 may obtain a time segment based, at least in part, on one or more bits indicative of a frame length (L) and one or more bits indicative of a spatio-temporal interpolation time (e.g., the codedSpatioInterpolationTime syntax element). The audio encoding device 20 may also obtain decomposed interpolated spherical harmonic coefficients for the time segment by, at least in part, performing an interpolation with respect to the first decomposition of the first plurality of spherical harmonic coefficients and the second decomposition of the second plurality of spherical harmonic coefficients.

The audio decoding device 24 may perform substantially similar operations to those described above with respect to the audio encoding device 20. In particular, the spatio-temporal interpolation unit 76 of the audio decoding device 24 may obtain the frame length as a function of the one or more bits indicative of the frame length factor (e.g., the frameLengthFactor syntax element) and the core coder frame length (which may also be specified in the bitstream 21 by the psychoacoustic audio encoding unit 40). The spatio-temporal interpolation unit 76 may also obtain the one or more bits indicative of the spatio-temporal interpolation time (e.g., the CodedSpatialInterpolationTime syntax element). The spatio-temporal interpolation unit 76 may perform a lookup in the table noted above using the frame length L and the codedSpatialInterpolationTim syntax element as keys to identifying the time segment length. The audio decoding device 24 may then perform the interpolation in the manner described above for the obtained time segment.

In this respect, the audio decoding device 24 may obtain a time segment based, at least in part, on one or more bits indicative of a frame length (L) and one or more bits indicative of a spatio-temporal interpolation time (e.g., the codedSpatioInterpolationTime syntax element). The audio decoding device 24 may also obtain decomposed interpolated spherical harmonic coefficients for the time segment by, at least in part, performing an interpolation with respect to the first decomposition of the first plurality of spherical harmonic coefficients and the second decomposition of the second plurality of spherical harmonic coefficients.

Figure 13:
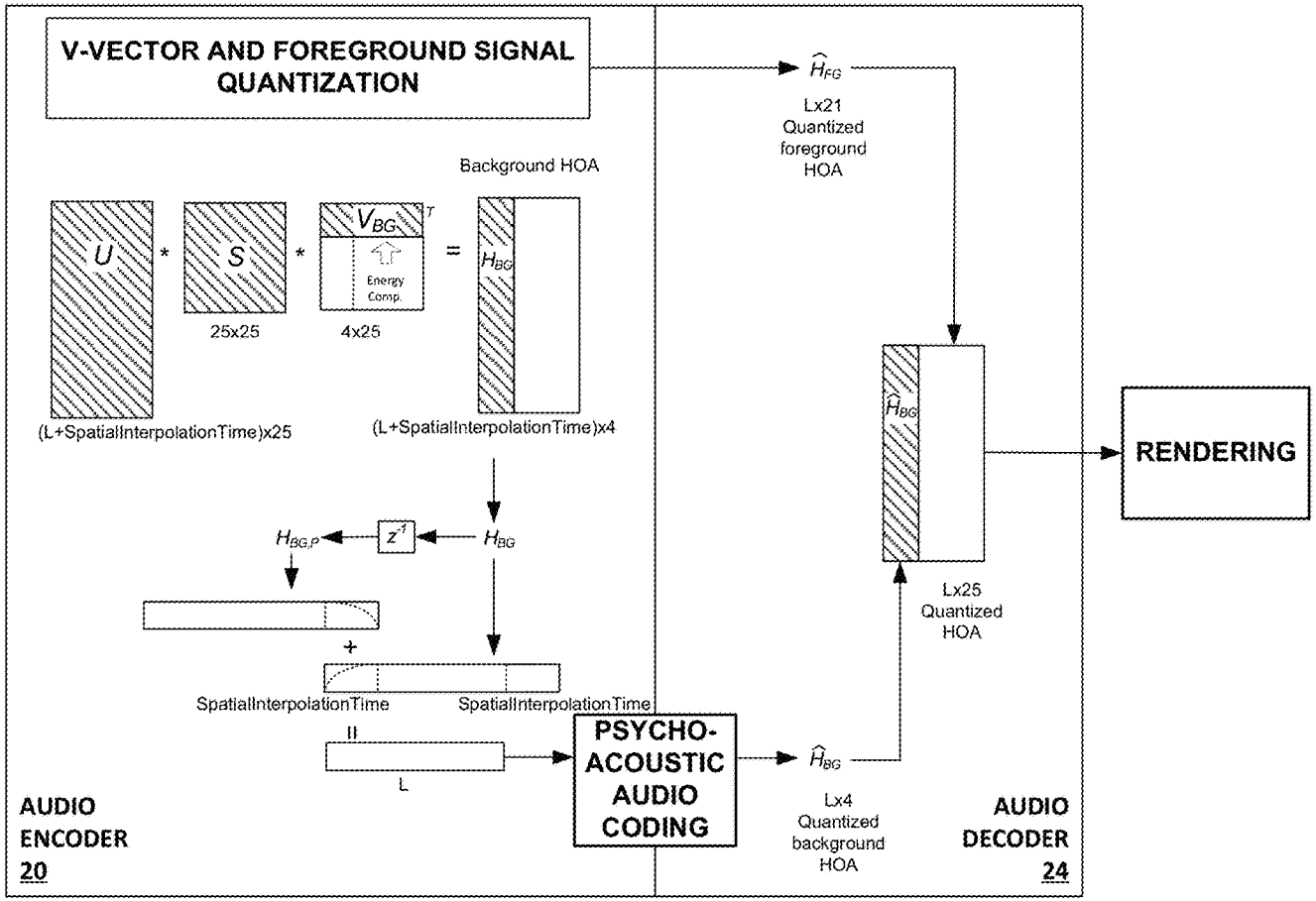
FIG. 13 is a diagram illustrating one or more an audio encoder and an audio decoder configured to perform one or more techniques described in this disclosure.

FIG. 13 is a diagram illustrating one or more an audio encoder and an audio decoder configured to perform one or more techniques described in this disclosure. As discussed above, SVD may be utilized as a basis for an HOA-signal compression system. In some examples, an HOA signal H may be decomposed into USV' (' is a transpose of a matrix). In some examples, the first few rows of US and V matrices may be defined as background signals (e.g., ambient signals), and the first few columns of US and V matrices may be defined as foreground signals. In some examples, the background and foreground signals may be crossfaded in a similar way. However, crossfading the background and foreground signals in a similar may result in redundant calculations being performed. To reduce the calculations performed and to improve other aspects of the system, this disclosure describes a new crossfading algorithm for the background signal.

In some systems, the US matrix and the V matrix are separately crossfaded into the US_C matrix (e.g., the crossfaded US matrix) and the V_C matrix (e.g., the crossfaded V matrix), respectively. Then, the crossfaded HOA signal H_C may be reconstructed as US_C*V_C'. In accordance with one or more techniques of this disclosure, the original HOA signal H may be reconstructed as USV' (e.g., prior to crossfading). Crossfading may then be performed in the HOA domain as described throughout this disclosure.

As noted above, the length (or in other words, the number of samples) of the frame may vary (e.g., as a function of the core coder frame length). The difference in frame length along with the different sets of the spatio-temporal interpolation times may impact crossfading as described above. In general, the spatio-temporal interpolation time identified by the CodedSpatialInterpolationTime syntax element and the frame length L may specify the number of samples to be crossfaded. As shown in the example of FIG. 13, the size of the U matrix is (L+SpatialInterpolationTime)*25, where the SpatialInterpolationTime variable denotes the spatial interpolation time as obtained as a function of the CodedSpatialInterpolationTime syntax element and L using the table discussed above with respect to FIG. 12. An example value for the SpatialInterpolationTime may be 256 when L equals 1024 and the value of the CodedSpatialInterpolationTime syntax element equals three. Another example value for the SpatialInterpolationTime, which will be used for purposes of illustration below, may be 512 when L equals 2048 and the value of the CodedSpatialInterpolationTime syntax element equals three. Under this illustrative example, the L+SpatialInterpolationTime equals 2048+512 or 2560.

In any event, the background HOA coefficients are of dimension 2560*4 in this example. The crossfade therefore occurs between the SptailInterpolationTime number of samples (e.g., 512 samples) of the previous frame and the first SptailInterpolationTime number of samples (e.g., 512 samples) of the current frame. The output is therefore L samples, which are AAC or USAC coded. Accordingly, the SpatialInterpolationTime used for spatio-temporally interpolating V-vectors may also identify the number of samples over which crossfading is performed. In this way, the crossfading duration may be impacted by one or more bits indicative of the FrameLength and one or more bits indicative of a spatio-temporal interpolation time.

Moreover, the energy compensation unit 38 may perform the energy compensation to generate the ambient HOA coefficients 47' by applying a windowing function to the $V_{BG}[k]$ vectors $\mathbf{35}_{BG}$ to generate the energy compensated $V_{BG}[k]$ vectors $\mathbf{35}_{BG}'$. The windowing function may comprise a windowing function having a length equal to the frame length L. In this respect, the energy compensation unit 38 may use the same frame length L for the energy compensation obtained, at least in part, on the one or more bits indicative of the frame length factor (e.g., the FrameLengthFactor syntax element).

the mixer unit 70 of the crossfade unit 66 may combine (e.g., crossfade between) the first portion 73 of the energy compensated ambient HOA coefficients 47' of the current frame and the third portion 76 of the energy compensated ambient HOA coefficients 47' of the previous frame to generate intermediate crossfaded energy compensated ambient HOA coefficients 77. The mixer unit 70 may output the generated intermediate crossfaded energy compensated ambient HOA coefficients 77 to the framing unit 71. As the mixer unit 70 utilizes the third portion 76 of the energy compensated ambient HOA coefficients 47' of the previous frame, in this example, it can be assumed that the crossfade unit 66 was in operation prior to processing the current frame. As such, as opposed to separately crossfading the US matrix of the current frame with the US matrix of the previous frame and the V matrix of the current frame with the V matrix of the previous frame, the mixer unit 70 may crossfade in the energy compensated domain. In this way, techniques according to the disclosure may reduce the computational load, power consumption, and/or complexity of the crossfade unit 66.

The foregoing techniques may be performed with respect to any number of different contexts and audio ecosystems. A number of example contexts are described below, although the techniques should be limited to the example contexts. One example audio ecosystem may include audio content, movie studios, music studios, gaming audio studios, channel based audio content, coding engines, game audio stems, game audio coding/rendering engines, and delivery systems.

The movie studios, the music studios, and the gaming audio studios may receive audio content. In some examples, the audio content may represent the output of an acquisition. The movie studios may output channel based audio content (e.g., in 2.0, 5.1, and 7.1) such as by using a digital audio workstation (DAW). The music studios may output channel based audio content (e.g., in 2.0, and 5.1) such as by using a DAW. In either case, the coding engines may receive and encode the channel based audio content based one or more codecs (e.g., AAC, AC3, Dolby True HD, Dolby Digital Plus, and DTS Master Audio) for output by the delivery systems. The gaming audio studios may output one or more game audio stems, such as by using a DAW. The game audio coding/rendering engines may code and or render the audio stems into channel based audio content for output by the delivery systems. Another example context in which the techniques may be performed comprises an audio ecosystem that may include broadcast recording audio objects, professional audio systems, consumer on-device capture, HOA audio format, on-device rendering, consumer audio, TV, and accessories, and car audio systems.

The broadcast recording audio objects, the professional audio systems, and the consumer on-device capture may all code their output using HOA audio format. In this way, the audio content may be coded using the HOA audio format into a single representation that may be played back using the on-device rendering, the consumer audio, TV, and accessories, and the car audio systems. In other words, the single representation of the audio content may be played back at a generic audio playback system (i.e., as opposed to requiring a particular configuration such as 5.1, 7.1, etc.), such as audio playback system 16.

Other examples of context in which the techniques may be performed include an audio ecosystem that may include acquisition elements, and playback elements. The acquisition elements may include wired and/or wireless acquisition devices (e.g., Eigen microphones), on-device surround sound capture, and mobile devices (e.g., smartphones and tablets). In some examples, wired and/or wireless acquisition devices may be coupled to mobile device via wired and/or wireless communication channel(s).

In accordance with one or more techniques of this disclosure, the mobile device may be used to acquire a soundfield. For instance, the mobile device may acquire a soundfield via the wired and/or wireless acquisition devices and/or the on-device surround sound capture (e.g., a plurality of microphones integrated into the mobile device). The mobile device may then code the acquired soundfield into the HOA coefficients for playback by one or more of the playback elements. For instance, a user of the mobile device may record (acquire a soundfield of) a live event (e.g., a meeting, a conference, a play, a concert, etc.), and code the recording into HOA coefficients.

The mobile device may also utilize one or more of the playback elements to playback the HOA coded soundfield. For instance, the mobile device may decode the HOA coded soundfield and output a signal to one or more of the playback elements that causes the one or more of the playback elements to recreate the soundfield. As one example, the mobile device may utilize the wireless and/or wireless communication channels to output the signal to one or more speakers (e.g., speaker arrays, sound bars, etc.). As another example, the mobile device may utilize docking solutions to output the signal to one or more docking stations and/or one or more docked speakers (e.g., sound systems in smart cars and/or homes). As another example, the mobile device may utilize headphone rendering to output the signal to a set of headphones, e.g., to create realistic binaural sound.

In some examples, a particular mobile device may both acquire a 3D soundfield and playback the same 3D soundfield at a later time. In some examples, the mobile device may acquire a 3D soundfield, encode the 3D soundfield into HOA, and transmit the encoded 3D soundfield to one or more other devices (e.g., other mobile devices and/or other non-mobile devices) for playback.

Yet another context in which the techniques may be performed includes an audio ecosystem that may include audio content, game studios, coded audio content, rendering engines, and delivery systems. In some examples, the game studios may include one or more DAWs which may support editing of HOA signals. For instance, the one or more DAWs may include HOA plugins and/or tools which may be configured to operate with (e.g., work with) one or more game audio systems. In some examples, the game studios may output new stem formats that support HOA. In any case, the game studios may output coded audio content to the rendering engines which may render a soundfield for playback by the delivery systems.

The techniques may also be performed with respect to exemplary audio acquisition devices. For example, the techniques may be performed with respect to an Eigen microphone which may include a plurality of microphones that are collectively configured to record a 3D soundfield. In some examples, the plurality of microphones of Eigen microphone may be located on the surface of a substantially spherical ball with a radius of approximately 4 cm. In some examples, the audio encoding device 20 may be integrated into the Eigen microphone so as to output a bitstream 21 directly from the microphone.

Another exemplary audio acquisition context may include a production truck which may be configured to receive a signal from one or more microphones, such as one or more Eigen microphones. The production truck may also include an audio encoder, such as audio encoder 20 of FIG. 3.

The mobile device may also, in some instances, include a plurality of microphones that are collectively configured to record a 3D soundfield. In other words, the plurality of microphone may have X, Y, Z diversity. In some examples, the mobile device may include a microphone which may be rotated to provide X, Y, Z diversity with respect to one or more other microphones of the mobile device. The mobile device may also include an audio encoder, such as audio encoder 20 of FIG. 3.

A ruggedized video capture device may further be configured to record a 3D soundfield. In some examples, the ruggedized video capture device may be attached to a helmet of a user engaged in an activity. For instance, the ruggedized video capture device may be attached to a helmet of a user whitewater rafting. In this way, the ruggedized video capture device may capture a 3D soundfield that represents the action all around the user (e.g., water crashing behind the user, another rafter speaking in front of the user, etc. . . . ).

The techniques may also be performed with respect to an accessory enhanced mobile device, which may be configured to record a 3D soundfield. In some examples, the mobile device may be similar to the mobile devices discussed above, with the addition of one or more accessories. For instance, an Eigen microphone may be attached to the above noted mobile device to form an accessory enhanced mobile device. In this way, the accessory enhanced mobile device may capture a higher quality version of the 3D soundfield than just using sound capture components integral to the accessory enhanced mobile device.

Example audio playback devices that may perform various aspects of the techniques described in this disclosure are further discussed below. In accordance with one or more techniques of this disclosure, speakers and/or sound bars may be arranged in any arbitrary configuration while still playing back a 3D soundfield. Moreover, in some examples, headphone playback devices may be coupled to a decoder 24 via either a wired or a wireless connection. In accordance with one or more techniques of this disclosure, a single generic representation of a soundfield may be utilized to render the soundfield on any combination of the speakers, the sound bars, and the headphone playback devices.

A number of different example audio playback environments may also be suitable for performing various aspects of the techniques described in this disclosure. For instance, a 5.1 speaker playback environment, a 2.0 (e.g., stereo) speaker playback environment, a 9.1 speaker playback environment with full height front loudspeakers, a 22.2 speaker playback environment, a 16.0 speaker playback environment, an automotive speaker playback environment, and a mobile device with ear bud playback environment may be suitable environments for performing various aspects of the techniques described in this disclosure.

In accordance with one or more techniques of this disclosure, a single generic representation of a soundfield may be utilized to render the soundfield on any of the foregoing playback environments. Additionally, the techniques of this disclosure enable a rendered to render a soundfield from a generic representation for playback on the playback environments other than that described above. For instance, if design considerations prohibit proper placement of speakers according to a 7.1 speaker playback environment (e.g., if it is not possible to place a right surround speaker), the techniques of this disclosure enable a render to compensate with the other 6 speakers such that playback may be achieved on a 6.1 speaker playback environment.

Moreover, a user may watch a sports game while wearing headphones. In accordance with one or more techniques of this disclosure, the 3D soundfield of the sports game may be acquired (e.g., one or more Eigen microphones may be placed in and/or around the baseball stadium), HOA coefficients corresponding to the 3D soundfield may be obtained and transmitted to a decoder, the decoder may reconstruct the 3D soundfield based on the HOA coefficients and output the reconstructed 3D soundfield to a renderer, the renderer may obtain an indication as to the type of playback environment (e.g., headphones), and render the reconstructed 3D soundfield into signals that cause the headphones to output a representation of the 3D soundfield of the sports game.

In each of the various instances described above, it should be understood that the audio encoding device 20 may perform a method or otherwise comprise means to perform each step of the method for which the audio encoding device 20 is configured to perform In some instances, the means may comprise one or more processors. In some instances, the one or more processors may represent a special purpose processor configured by way of instructions stored to a non-transitory computer-readable storage medium. In other words, various aspects of the techniques in each of the sets of encoding examples may provide for a non-transitory computer-readable storage medium having stored thereon instructions that, when executed, cause the one or more processors to perform the method for which the audio encoding device 20 has been configured to perform.

In one or more examples, the functions described may be implemented in hardware, software, firmware, or any combination thereof. If implemented in software, the functions may be stored on or transmitted over as one or more instructions or code on a computer-readable medium and executed by a hardware-based processing unit. Computer-readable media may include computer-readable storage media, which corresponds to a tangible medium such as data storage media. Data storage media may be any available media that can be accessed by one or more computers or one or more processors to retrieve instructions, code and/or data structures for implementation of the techniques described in this disclosure. A computer program product may include a computer-readable medium.

Likewise, in each of the various instances described above, it should be understood that the audio decoding device 24 may perform a method or otherwise comprise means to perform each step of the method for which the audio decoding device 24 is configured to perform. In some instances, the means may comprise one or more processors. In some instances, the one or more processors may represent a special purpose processor configured by way of instructions stored to a non-transitory computer-readable storage medium. In other words, various aspects of the techniques in each of the sets of encoding examples may provide for a non-transitory computer-readable storage medium having stored thereon instructions that, when executed, cause the one or more processors to perform the method for which the audio decoding device 24 has been configured to perform.

By way of example, and not limitation, such computer-readable storage media can comprise RAM, ROM, EEPROM, CD-ROM or other optical disk storage, magnetic disk storage, or other magnetic storage devices, flash memory, or any other medium that can be used to store desired program code in the form of instructions or data structures and that can be accessed by a computer. It should be understood, however, that computer-readable storage media and data storage media do not include connections, carrier waves, signals, or other transitory media, but are instead directed to non-transitory, tangible storage media. Disk and disc, as used herein, includes compact disc (CD), laser disc, optical disc, digital versatile disc (DVD), floppy disk and Blu-ray disc, where disks usually reproduce data magnetically, while discs reproduce data optically with lasers. Combinations of the above should also be included within the scope of computer-readable media.

Instructions may be executed by one or more processors, such as one or more digital signal processors (DSPs), general purpose microprocessors, application specific integrated circuits (ASICs), field programmable logic arrays (FPGAs), or other equivalent integrated or discrete logic circuitry. Accordingly, the term "processor," as used herein may refer to any of the foregoing structure or any other structure suitable for implementation of the techniques described herein. In addition, in some aspects, the functionality described herein may be provided within dedicated hardware and/or software modules configured for encoding and decoding, or incorporated in a combined codec. Also, the techniques could be fully implemented in one or more circuits or logic elements.

The techniques of this disclosure may be implemented in a wide variety of devices or apparatuses, including a wireless handset, an integrated circuit (IC) or a set of ICs (e.g., a chip set). Various components, modules, or units are described in this disclosure to emphasize functional aspects of devices configured to perform the disclosed techniques, but do not necessarily require realization by different hardware units. Rather, as described above, various units may be combined in a codec hardware unit or provided by a collection of interoperative hardware units, including one or more processors as described above, in conjunction with suitable software and/or firmware.

Various aspects of the techniques have been described. These and other aspects of the techniques are within the scope of the following claims.

The invention claimed is:

1. A method comprising:

obtaining, by an audio encoder, a decomposition of spherical harmonic coefficients (SHCs) that correspond to a first set of ambient SHCs, the decomposition including a first set of vectors representing spatial characteristics of an ambient sound field and a second set of vectors representing temporal and energy characteristics of the ambient sound field;

performing, by the audio encoder, energy compensation with respect to the first set of vectors to obtain a set of energy compensated vectors;

multiplying, by the audio encoder, the set of energy compensated vectors by the second set of vectors to obtain a first set of energy compensated ambient SHCs;

crossfading, by the audio encoder, between the first set of energy compensated ambient spherical harmonic coefficients (SHCs) and a second set of energy compensated ambient SHCs to obtain a first set of crossfaded energy compensated ambient SHCs.

2. The method of claim 1, wherein the first set of SHCs include SHCs corresponding to basis functions having an order greater than one, and wherein the second set of SHCs include SHCs corresponding to basis functions having an order greater than one.

3. The method of claim 1, wherein performing the energy compensation comprises performing the energy compensation using a windowing function obtained as a function, at least in part, of one or more bits indicative of a frame length.

4. The method of claim 1, wherein the first set of energy compensated ambient SHCs correspond to a current frame, and wherein the second set of energy compensated ambient SHCs correspond to a previous frame.

5. The method of claim 1, wherein crossfading comprises modifying a portion of the first set of energy compensated ambient SHCs based on a portion of the second set of energy compensated ambient SHCs.

6. An audio decoding device comprising:

a memory configured to store a first set of vectors representing spatial characteristics of a foreground sound field, a second set of vectors representing temporal and energy characteristics of the foreground sound field, a first set of energy compensated ambient spherical harmonic coefficients (SHCs), and a second set of energy compensated ambient SHCs, wherein the first set of energy compensated ambient SHCs describe a first ambient sound field and the second set of energy compensated ambient SHCs describe a second ambient sound field, and one or more processors, coupled to the memory, configured to:

crossfade between the first set of energy compensated ambient SHCs and the second set of energy compensated ambient SHCs to obtain a first set of crossfaded energy compensated ambient SHCs; and render, based on the first set of vectors, the second set of vectors, and the first set of crossfaded energy compensated ambient SHCs, one or more speaker feeds.

7. The audio decoding device of claim 6, wherein the first set of SHCs include SHCs corresponding to basis functions having an order greater than one, and wherein the second set of SHCs include SHCs corresponding to basis functions having an order greater than one.

8. The audio decoding device of claim 6, wherein the first set of energy compensated ambient SHCs correspond to a current frame, and wherein the second set of energy compensated ambient SHCs correspond to a previous frame.

9. The audio decoding device of claim 6, wherein the one or more processors are configured to crossfade by at least modifying a portion of the first set of energy compensated ambient SHCs based on a portion of the second set of energy compensated ambient SHCs.

10. The audio decoding device of claim 6, further comprising a speaker configured to reproduce, based on the speaker feeds, a sound field.

11. An audio encoding device comprising:

one or more processors configured to:

obtain a decomposition of spherical harmonic coefficients (SHCs) that correspond to a first set of ambient SHCs, the decomposition including a first set of vectors representing spatial characteristics of an ambient sound field and a second set of vectors representing temporal and energy characteristics of the ambient sound field;

perform energy compensation with respect to the first set of vectors to obtain a set of energy compensated vectors;

multiply the set of energy compensated vectors by the second set of vectors to obtain a first set of energy compensated ambient SHCs;

a memory, coupled to the one or more processors, configured to store the first set of energy compensated ambient spherical harmonic coefficients (SHCs) and a second set of energy compensated ambient SHCs, and wherein the one or more processors are further configured to crossfade between the first set of energy compensated ambient SHCs and the second set of energy compensated ambient SHCs to obtain a first set of crossfaded energy compensated ambient SHCs.

12. The audio encoding device of claim 11, wherein the first set of SHCs include SHCs corresponding to basis functions having an order greater than one, and wherein the second set of SHCs include SHCs corresponding to basis functions having an order greater than one.

13. The audio encoding device of claim 11, wherein the one or more processors are configured to perform the energy compensation using a windowing function obtained as a function, at least in part, of one or more bits indicative of a frame length.

14. The audio encoding device of claim 11, wherein the first set of energy compensated ambient SHCs correspond to a current frame, and wherein the second set of energy compensated ambient SHCs correspond to a previous frame.

15. The audio encoding device of claim 11, wherein the one or more processors are configured to crossfade by at least modifying a portion of the first set of energy compensated ambient SHCs based on a portion of the second set of energy compensated ambient SHCs.

16. The audio encoding device of claim 11, further comprising a microphone configured to capture audio data indicative of the first and second sets of ambient SHCs.

17. The method of claim 1, wherein the device is the audio encoder, the method further comprises capturing, by a microphone coupled to the audio encoder, audio data representative of a first set of ambient SHCs and a second set of ambient SHCs.

18. The method of claim 1, wherein the device is the audio decoder, the method further comprises:

rendering one or more loudspeaker feeds based on the first set of crossfaded energy compensated ambient SHCs; and reproducing, by one or more loudspeakers coupled to the audio decoder and based on the one or more loudspeaker feeds, a crossfaded ambient soundfield represented by the first set of crossfaded energy compensated ambient SHCs.

19. The audio decoding device of claim 6, wherein the audio decoding device further comprises one or more speakers coupled to the one or more processors and configured to reproduce, based on the one or more speaker feeds, a sound field.

20. A method comprising:

obtain, by an audio decoder, a first set of vectors representing spatial characteristics of a foreground sound field and a second set of vectors representing temporal and energy characteristics of the foreground sound field, obtain, by the audio decoder, a first set of energy compensated ambient spherical harmonic coefficients (SHCs) and a second set of energy compensated ambient SHCs, wherein the first set of energy compensated ambient SHCs describe a first ambient sound field and the second set of energy compensated ambient SHCs describe a second ambient sound field, and crossfading, by the audio decoder, between the first set of energy compensated ambient SHCs and the second set of energy compensated ambient SHCs to obtain a first set of crossfaded energy compensated ambient SHCs; and render, by the audio decoder and based on the first set of vectors, the second set of vectors, and the first set of crossfaded energy compensated ambient SHCs, one or more speaker feeds.

21. The method of claim 20, wherein the first set of SHCs include SHCs corresponding to basis functions having an order greater than one, and wherein the second set of SHCs include SHCs corresponding to basis functions having an order greater than one.

22. The method of claim 20, wherein the first set of energy compensated ambient SHCs correspond to a current frame, and wherein the second set of energy compensated ambient SHCs correspond to a previous frame.

23. The method of claim 20, wherein crossfading between the first set of energy compensated ambient SHCs and the second set of energy compensated SHCs comprises crossfading by at least modifying a portion of the first set of energy compensated ambient SHCs based on a portion of the second set of energy compensated ambient SHCs.

24. The method of claim 20, further comprising reproducing, by one or more speakers and based on the one or more speaker feeds, a sound field.

25. The method of claim 20, wherein obtaining the first set of energy compensated SHCs and the second set of energy compensated SHCs comprises obtaining a bitstream that includes a representation of the crossfaded energy compensated ambient SHCs and a representation of crossfaded foreground SHCs that correspond to the crossfaded energy compensated ambient SHCs.

26. The method of claim 20, wherein the first set of vectors and the second set of vectors represent crossfaded foreground SHCs, and wherein obtaining the first set of vectors and the second set of vectors comprises obtaining a bitstream that includes a representation of the crossfaded foreground SHCs.

* * * * *